US009682757B1

(12) United States Patent
Bourret

(10) Patent No.: US 9,682,757 B1
(45) Date of Patent: Jun. 20, 2017

(54) METHOD FOR REVERSING A JET PROPELLED WATERCRAFT

(71) Applicant: BRP US INC., Sturtevant, WI (US)

(72) Inventor: Robert Bourret, Palm Bay, FL (US)

(73) Assignee: BRP US INC., Sturtevant, WI (US)

( * ) Notice: Subject to any disclaimer, the term of this patent is extended or adjusted under 35 U.S.C. 154(b) by 0 days.

(21) Appl. No.: 15/220,970

(22) Filed: Jul. 27, 2016

Related U.S. Application Data

(60) Provisional application No. 62/289,093, filed on Jan. 29, 2016.

(51) Int. Cl.
*B63H 11/11* (2006.01)
*B63H 11/113* (2006.01)

(52) U.S. Cl.
CPC ..... *B63H 11/113* (2013.01)

(58) Field of Classification Search
CPC ..... B63H 11/11; B63H 11/113
USPC ..... 440/41–42
See application file for complete search history.

(56) References Cited

U.S. PATENT DOCUMENTS 6,533,623 B2 * 3/2003 Simard ..... B63H 11/117 440/41
7,124,703 B2 * 10/2006 Richard ..... B63B 35/731 114/363
7,674,144 B2 * 3/2010 Bourret ..... B63H 11/11 440/38
7,708,609 B2 * 5/2010 Plante ..... B63H 11/11 440/1
7,775,844 B2 * 8/2010 St-Pierre ..... B63H 11/08 440/40
7,841,915 B2 * 11/2010 Bourret ..... B63H 11/107 440/41
7,892,053 B2 2/2011 St-Pierre et al.
7,901,259 B2 * 3/2011 Bourret ..... B63B 35/731 440/41
8,000,851 B2 8/2011 St-Pierre et al.
8,166,900 B2 * 5/2012 Kamio ..... B63H 25/44 114/145 R
8,177,592 B2 * 5/2012 Kamio ..... B63B 35/731 114/145 R
8,177,594 B2 * 5/2012 Dagenais ..... B63H 11/11 441/1
8,202,136 B2 * 6/2012 Dagenais ..... B63H 11/08 440/41
8,478,465 B2 7/2013 St-Pierre et al.
8,998,661 B2 * 4/2015 Kinoshita ..... B63H 21/21 440/1

(Continued)

FOREIGN PATENT DOCUMENTS

WO 2008025169 A1 3/2008

*Primary Examiner* — Lars A Olson
*Assistant Examiner* — Jovon Hayes
(74) *Attorney, Agent, or Firm* — BCF LLP

(57) ABSTRACT

A method for reversing a watercraft is disclosed. The watercraft has a reverse gate and a reverse gate actuator operatively connected to the reverse gate for moving the reverse gate between at least a stowed position and a reverse position. The method includes moving the reverse gate from the stowed position to the reverse position with the reverse gate actuator in response to receiving a reverse signal. The reverse gate actuator is controlled such that a movement speed of the reverse gate depends on at least one of a speed of the watercraft and a motor speed of a motor of the watercraft.

20 Claims, 26 Drawing Sheets

(56) References Cited

U.S. PATENT DOCUMENTS

| | | | | |
|---|---|---|---|---|
| 9,248,895 | B1 * | 2/2016 | Gendron | B63H 11/11 |
| 9,517,826 | B1 * | 12/2016 | Leblond | B63H 21/21 |
| 2009/0275248 | A1 * | 11/2009 | Plante | B63H 11/11 440/1 |
| 2010/0022145 | A1 * | 1/2010 | Dagenais | B63H 11/11 440/41 |
| 2012/0021659 | A1 * | 1/2012 | Ota | B63H 11/113 440/41 |

* cited by examiner

METHOD FOR REVERSING A JET PROPELLED WATERCRAFT

CROSS-REFERENCE

The present application claims priority to U.S. Provisional Patent Application No. 62/289,093, filed Jan. 29, 2016, the entirety of which is incorporated herein by reference.

FIELD OF TECHNOLOGY

The present technology relates to a method for reversing a jet propelled watercraft.

BACKGROUND

In jet propelled watercraft, such as personal watercraft or jet propelled boats, the watercraft can be propelled in reverse by lowering a reverse gate behind the output of the water jet thus redirecting the jet toward the front of the watercraft which creates a thrust in the reverse direction. The reverse gate is actuated by a hand activated reverse gate operator which, when pulled, lowers the reverse gate behind of the water jet. By actuating a throttle operator of the watercraft, which may or may not be the same device as the reverse gate operator, the amount of thrust generated by the jet propulsion system changes. Therefore, by controlling the position of the reverse gate and the amount of thrust generated by the jet propulsion system, and by actuating the reverse gate operator and the throttle operator respectively, the driver of the watercraft can control the amount of reverse thrust being generated.

Although manufacturers advise against such manoeuvres, some watercraft drivers actuate the reverse gate and request that a maximum amount of thrust be generated while going at high forward speed in an attempt to rapidly decelerate the watercraft to then start moving in reverse. However doing this in an uncontrolled manner could adversely affect control of the watercraft, and could damage the jet propulsion system and/or the reverse gate.

Therefore there is a desire for a method for reversing a watercraft when the reverse command by the driver of the watercraft is initiated while the watercraft is moving forward.

SUMMARY

It is an object of the present technology to ameliorate at least some of the inconveniences present in the prior art.

In one aspect, implementations of the present technology provide a method for reversing a watercraft. The watercraft has a hull, a deck disposed on the hull, a motor connected to at least one of the hull and the deck, a jet propulsion system operatively connected to the motor, a reverse gate connected to at least one of the hull, the deck and the jet propulsion system, the reverse gate being movable between at least a stowed position and a reverse position, and a reverse gate actuator operatively connected to the reverse gate for moving the reverse gate between at least the stowed position and the reverse position. The method comprises: receiving, in a control unit, a reverse signal from a reverse gate operator position sensor sensing a position of a reverse gate operator; receiving, in the control unit, a speed signal representative of at least one of a watercraft speed and a motor speed; controlling, by the control unit, an operation of the reverse gate actuator based at least in part on the speed signal; and moving the reverse gate from the stowed position to the reverse position with the reverse gate actuator in response to receiving the reverse signal, the reverse gate actuator being controlled such that a movement speed of the reverse gate depends on the speed signal.

According to some implementations of the present technology, the reverse gate actuator is controlled such that the movement speed of the reverse gate at a first of the at least one of the watercraft speed and the motor speed is greater than the movement speed of the reverse gate at a second of the at least one of the watercraft speed and the motor speed, the second of the at least one of the watercraft speed and the motor speed being greater than the first of the at least one of the watercraft speed and the motor speed.

According to some implementations of the present technology, the reverse gate actuator is controlled such that the movement speed of the reverse gate increases as the at least one of the watercraft speed and the motor speed decreases.

According to some implementations of the present technology, the at least one of the watercraft speed and the motor speed is the watercraft speed.

According to some implementations of the present technology, controlling the operation of the reverse gate actuator includes: applying a first power level to the reverse gate actuator at the first of the at least one of the watercraft speed and the motor speed; and applying a second power level to the reverse gate actuator at the second of the at least one of the watercraft speed and the motor speed. The first power level is greater than the second power level.

According to some implementations of the present technology, the method further comprises: receiving, in the control unit, a throttle signal from a throttle operator position sensor sensing a position of a throttle operator; and in response to receiving the reverse signal, limiting, by the control unit, an operation of the motor based at least in part on the at least one of the watercraft speed and the motor speed.

According to some implementations of the present technology, limiting the operation of the motor includes limiting at least one of: a degree of opening of a throttle valve; the motor speed; and a torque of the motor, to a reverse limit.

According to some implementations of the present technology, the reverse limit at the first of the at least one of the watercraft speed and the motor speed is greater than the reverse limit at the second of the at least one of the watercraft speed and the motor speed.

According to some implementations of the present technology, the reverse limit increases as the at least one of the watercraft speed and the motor speed decreases.

According to some implementations of the present technology, the at least one of the watercraft speed and the motor speed is the watercraft speed.

According to some implementations of the present technology, a maximum value of the reverse limit is less than a maximum value of a forward limit of the at least one of: the degree of opening of a throttle valve; the motor speed; and the torque of the motor, when a forward signal from the reverse gate operator position sensor is received in the control unit.

According to some implementations of the present technology, the at least one of: the degree of opening of a throttle valve; the motor speed; and the torque of the motor, is the torque of the motor.

According to some implementations of the present technology, the reverse gate operator and the throttle operator are a single operator.

According to some implementations of the present technology, at the second of the at least one of the watercraft speed and the motor speed, the reverse gate actuator is controlled such that the movement speed of the reverse gate from the stowed position to a neutral position is greater than the movement speed of the reverse gate from the neutral position to the reverse position.

In another aspect, implementations of the present technology provide a method for reversing a watercraft. The watercraft has a hull, a deck disposed on the hull, a motor connected to at least one of the hull and the deck, a jet propulsion system operatively connected to the motor, a reverse gate connected to at least one of the hull, the deck and the jet propulsion system, the reverse gate being movable between at least a stowed position and a reverse position, and a reverse gate actuator operatively connected to the reverse gate for moving the reverse gate between at least the stowed position and the reverse position. The method comprises: receiving, in a control unit, a reverse signal from a reverse gate operator position sensor sensing a position of a reverse gate operator; receiving, in the control unit, a speed signal representative of at least one of a watercraft speed and a motor speed; controlling, by the control unit, an operation of the reverse gate actuator based at least in part on the speed signal; and moving the reverse gate from the stowed position to the reverse position with the reverse gate actuator in response to receiving the reverse signal, the reverse gate actuator being controlled such that a time taken to move the reverse gate from the stowed position to the reverse position depends on the speed signal.

According to some implementations of the present technology, the reverse gate actuator is controlled such that the time taken at a first of the at least one of the watercraft speed and the motor speed is smaller than the time taken at a second of the at least one of the watercraft speed and the motor speed, the second of the at least one of the watercraft speed and the motor speed being greater than the first of the at least one of the watercraft speed and the motor speed.

According to some implementations of the present technology, the reverse gate actuator is controlled such that the time taken decreases as a value of the at least one of the watercraft speed and the motor speed when the reverse signal is initially received decreases.

According to some implementations of the present technology, the at least one of the watercraft speed and the motor speed is the watercraft speed.

According to some implementations of the present technology, controlling the operation of the reverse gate actuator includes: applying a first power level to the reverse gate actuator at the first of the at least one of the watercraft speed and the motor speed; and applying a second power level to the reverse gate actuator at the second of the at least one of the watercraft speed and the motor speed. The first power level is greater than the second power level.

According to some implementations of the present technology, the method further comprises: receiving, in the control unit, a throttle signal from a throttle operator position sensor sensing a position of a throttle operator; and in response to receiving the reverse signal, limiting, by the control unit, an operation of the motor based at least in part on the at least one of the watercraft speed and the motor speed.

According to some implementations of the present technology, limiting the operation of the motor includes limiting at least one of: a degree of opening of a throttle valve; the motor speed; and a torque of the motor, to a reverse limit.

According to some implementations of the present technology, the reverse limit at the first of the at least one of the watercraft speed and the motor speed is greater than the reverse limit at the second of the at least one of the watercraft speed and the motor speed.

According to some implementations of the present technology, at the second of the at least one of the watercraft speed and the motor speed, the reverse gate actuator is controlled such that a movement speed of the reverse gate from the stowed position to a neutral position is greater than the movement speed of the reverse gate from the neutral position to the reverse position.

In one aspect, implementations of the present technology provide a watercraft having a hull; a deck disposed on the hull; a motor connected to one of the hull and the deck; a jet propulsion system operatively connected to the motor; a control unit communicating with the motor for controlling an operation of the motor; a reverse gate operatively connected to at least one of the hull, the deck and the jet propulsion system, the reverse gate being movable between at least a stowed position and a reverse position; a reverse gate actuator operatively connected to the reverse gate for moving the reverse gate between at least the stowed position and the reverse position, and being in communication with the control unit; a reverse gate operator position sensor in communication with the control unit; and a reverse gate operator connected to the reverse gate operator position sensor, the reverse gate operator position sensor sensing a position of the reverse gate operator. The control unit includes a processor; and a tangible computer readable storage medium communicating with the processor and storing instructions that cause the control unit to perform the steps of the method of any implementations of the above methods.

According to some implementations of the present technology, the reverse gate operator is also a throttle operator.

For purposes of this application, terms related to spatial orientation such as forwardly, rearwardly, left, and right, are as they would normally be understood by a driver of the watercraft sitting thereon in a normal driving position.

The present application also refers to various positions of a reverse gate. A stowed position of the reverse gate is a position where the reverse gate does not interfere with a jet of water expelled from a steering nozzle of a jet propulsion system. A fully stowed position is the stowed position where the reverse gate is pivoted to its maximum upward position. A lowered position is a position where the reverse gate redirects at least some of the jet of water expelled from the steering nozzle. A fully lowered position is the lowered position where the reverse gate is pivoted to its maximum downward position. A neutral position is a lowered position where the water redirected by the reverse gate does not generate a significant forward or rearward thrust. A reverse position is a lowered position toward which the reverse gate is moved to provide a reverse thrust when a reverse operator is actuated by a driver of the watercraft. The reverse position can be the fully lowered position or a position intermediate the neutral position and the fully lowered position.

Implementations of the present technology each have at least one of the above-mentioned object and/or aspects, but do not necessarily have all of them. It should be understood that some aspects of the present technology that have resulted from attempting to attain the above-mentioned object may not satisfy this object and/or may satisfy other objects not specifically recited herein.

Additional and/or alternative features, aspects and advantages of implementations of the present technology will become apparent from the following description, the accompanying drawings and the appended claims.

BRIEF DESCRIPTION OF THE DRAWINGS

For a better understanding of the present technology, as well as other aspects and further features thereof, reference is made to the following description which is to be used in conjunction with the accompanying drawings, where.

DETAILED DESCRIPTION

The present technology will be described with respect to a personal watercraft and a jet propelled boat. However, it should be understood that other types of watercraft are contemplated.

The general construction of a personal watercraft 10 will be described with respect to FIGS. 1 to 5. The following description relates to one way of manufacturing a personal watercraft. It should be recognized that there are other known ways of manufacturing and designing watercraft and that the present technology would encompass other known ways and designs. U.S. Pat. No. 7,124,703, issued Oct. 24, 2006, the entirety of which is incorporated herein by reference, describes one such other watercraft design.

Figure 1:
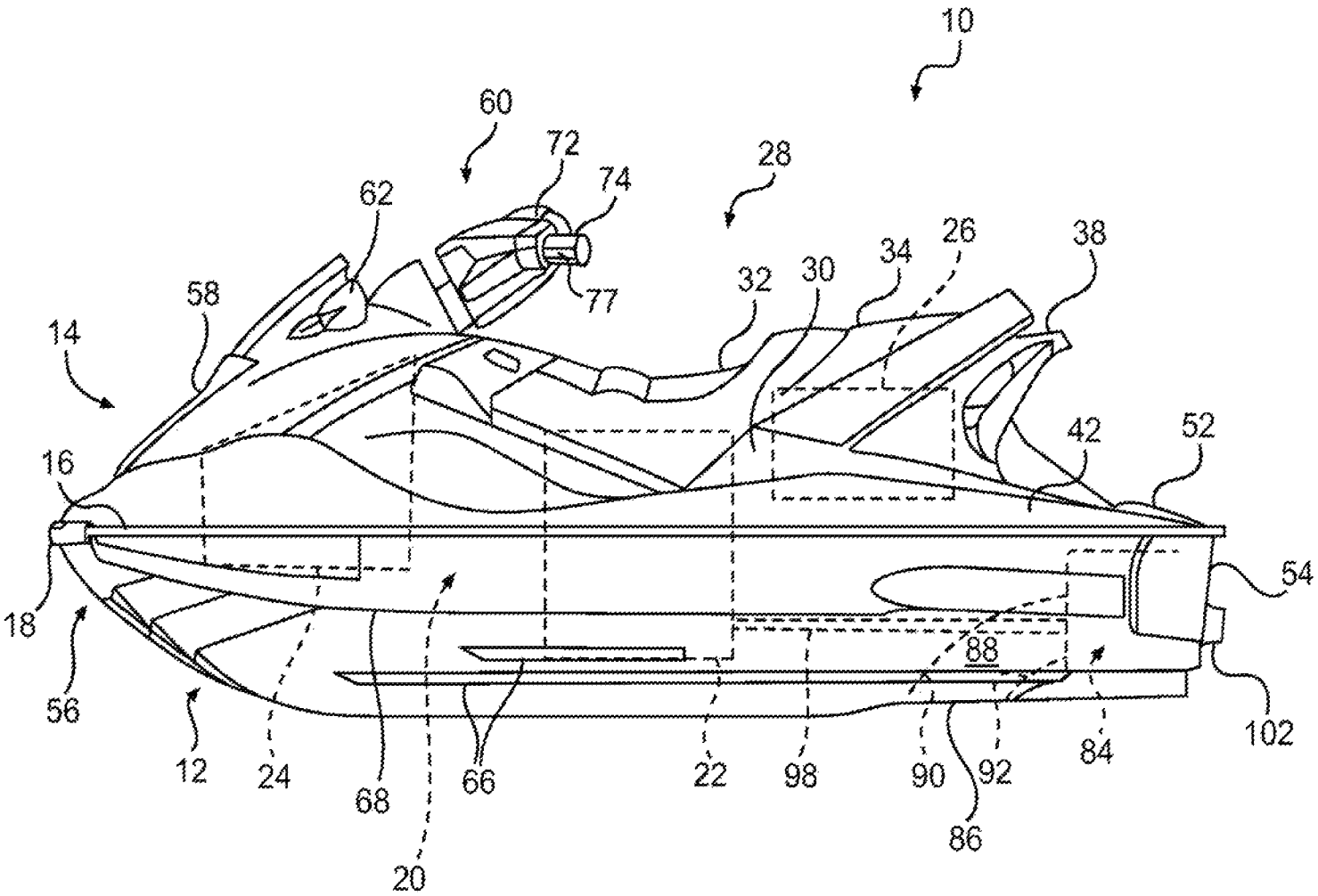
FIG. 1 is a left side elevation view of a personal watercraft.

The watercraft 10 of FIG. 1 has a hull 12 and a deck 14. The hull 12 buoyantly supports the watercraft 10 in the water. The deck 14 is designed to accommodate a driver and a passenger. The hull 12 and deck 14 are joined together at a seam 16 that joins the parts in a sealing relationship. The seam 16 comprises a bond line formed by an adhesive. Other known joining methods could be used to engage the parts together, including but not limited to, thermal fusion and fasteners such as rivets or screws. A bumper 18 generally covers the seam 16, which helps to prevent damage to the outer surface of the watercraft 10 when the watercraft 10 is docked, for example. The bumper 18 can extend around the bow 56, as shown, or around any portion or the entire seam 16.

The space between the hull 12 and the deck 14 forms a volume commonly referred to as the motor compartment 20 (shown in phantom). Shown schematically in FIG. 1, the motor compartment 20 accommodates a motor 22. In the present implementation, the motor 22 is an internal combustion engine 22. It is contemplated that the motor 22 could be any other type of motor such as an electric motor or a combination of an internal combustion engine and an electric motor. The motor compartment 20 also accommodates a muffler, tuning pipe, gas tank, electrical system (battery, electronic control unit, etc.), air box, storage bins 24, 26, and other elements required or desirable in the watercraft 10.

Figure 2:
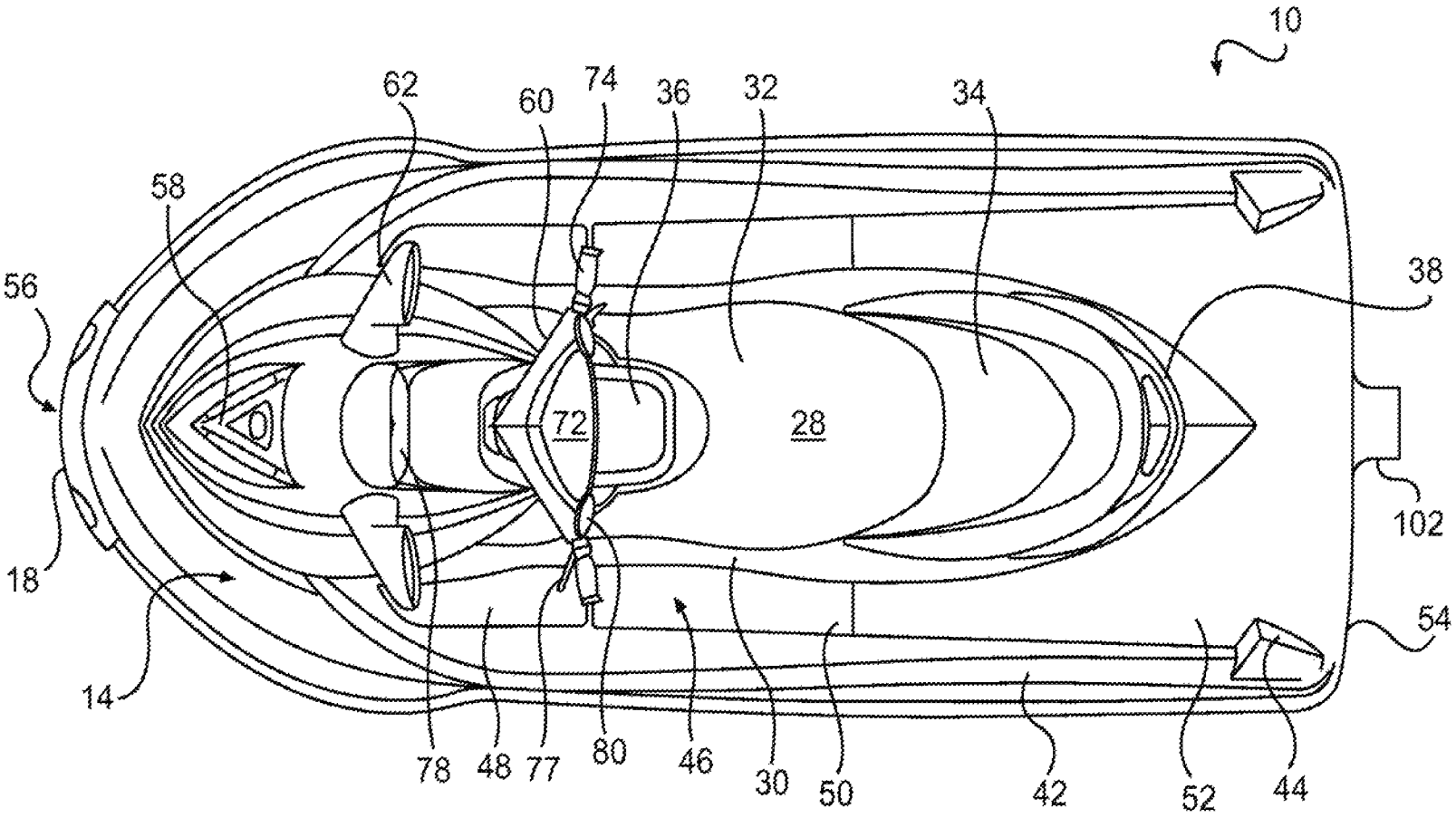
FIG. 2 is a top plan view of the watercraft of FIG. 1.

As seen in FIGS. 1 and 2, the deck 14 has a centrally positioned straddle-type seat 28 positioned on top of a pedestal 30 to accommodate the driver and the passenger in a straddling position. As seen in FIG. 2, the seat 28 includes a front seat portion 32 to accommodate the driver and a rear, raised seat portion 34 to accommodates the passenger. It is contemplated that the seat 28 could be configured to accommodate only the driver or to accommodate the driver and more than one passenger. The seat 28 is made as a cushioned or padded unit or interfitting units. The front and rear seat portions 32, 34 are removably attached to the pedestal 30 by a hook and tongue assembly (not shown) at the front of each seat portion and by a latch assembly (not shown) at the rear of each seat portion, or by any other known attachment mechanism. The seat portions 32, 34 can be individually tilted or removed completely. One of the seat portions 32, 34 covers an engine access opening (in this case above engine 22) defined by a top portion of the pedestal 30 to provide access to the engine 22 (FIG. 1). The other seat portion (in this case portion 34) covers a removable storage box 26 (FIG. 1). A small storage box 36 is provided in front of the seat 28.

Figure 4:
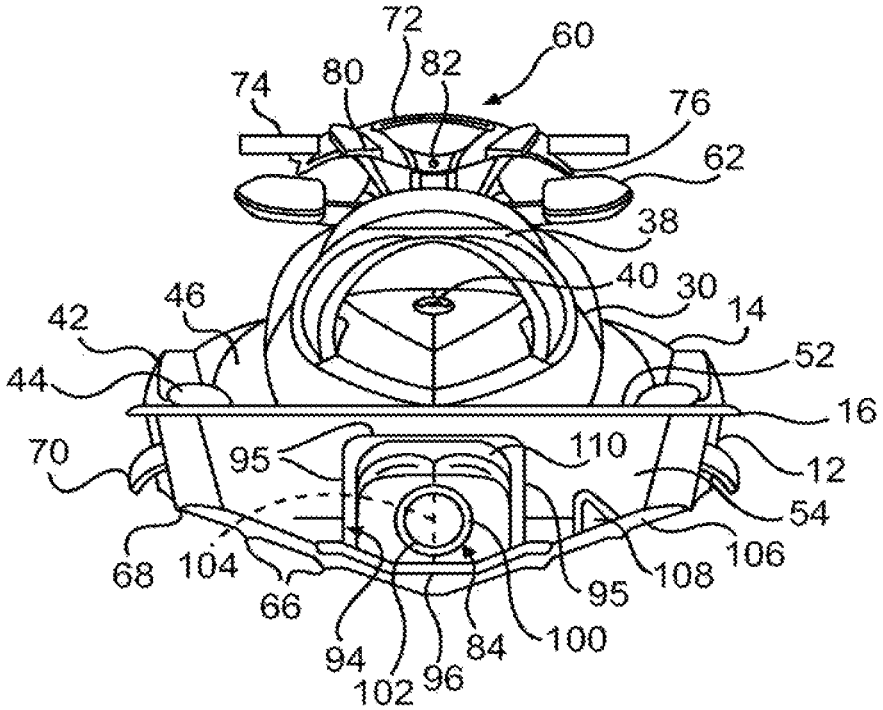
FIG. 4 is a rear elevation view of the watercraft of FIG. 1.

As seen in FIG. 4, a grab handle 38 is provided between the pedestal 30 and the rear of the seat 28 to provide a handle onto which the passenger may hold. This arrangement is particularly convenient for a passenger seated facing backwards for spotting a water skier, for example. Beneath the handle 38, a tow hook 40 is mounted on the pedestal 30. The tow hook 40 can be used for towing a skier or a floatation device, such as an inflatable water toy.

As best seen in FIGS. 2 and 4 the watercraft 10 has a pair of generally upwardly extending walls located on either side of the watercraft 10 known as gunwales or gunnels 42. The gunnels 42 help to prevent the entry of water in the footrests 46 of the watercraft 10, provide lateral support for the riders' feet, and also provide buoyancy when turning the watercraft 10, since personal watercraft roll slightly when turning. Towards the rear of the watercraft 10, the gunnels 42 extend inwardly to act as heel rests 44. Heel rests 44 allow the passenger riding the watercraft 10 facing towards the rear, to spot a water-skier for example, to place his or her heels on the heel rests 44, thereby providing a more stable riding position. The heel rests 44 could also be formed separate from the gunnels 42.

Footrests are located on both sides of the watercraft 10, between the pedestal 30 and the gunnels 42. The footrests 46 are designed to accommodate a rider's feet in various riding positions. To this effect, the footrests 46 each have a forward portion 48 angled such that the front portion of the forward portion 48 (toward the bow 56 of the watercraft 10) is higher, relative to a horizontal reference point, than the rear portion of the forward portion 48. The remaining portions of the footrests 46 are generally horizontal. It is contemplated that any contour conducive to a comfortable rest for the rider could be used. The footrests 46 are covered by carpeting 50 made of a rubber-type material, for example, to provide additional comfort and traction for the feet of the rider.

A reboarding platform 52 is provided at the rear of the watercraft 10 on the deck 14 to allow the rider or a passenger to easily reboard the watercraft 10 from the water. Carpeting or some other suitable covering covers the reboarding platform 52. A retractable ladder (not shown) may be affixed to the transom 54 to facilitate boarding the watercraft 10 from the water onto the reboarding platform 52.

Figure 3:
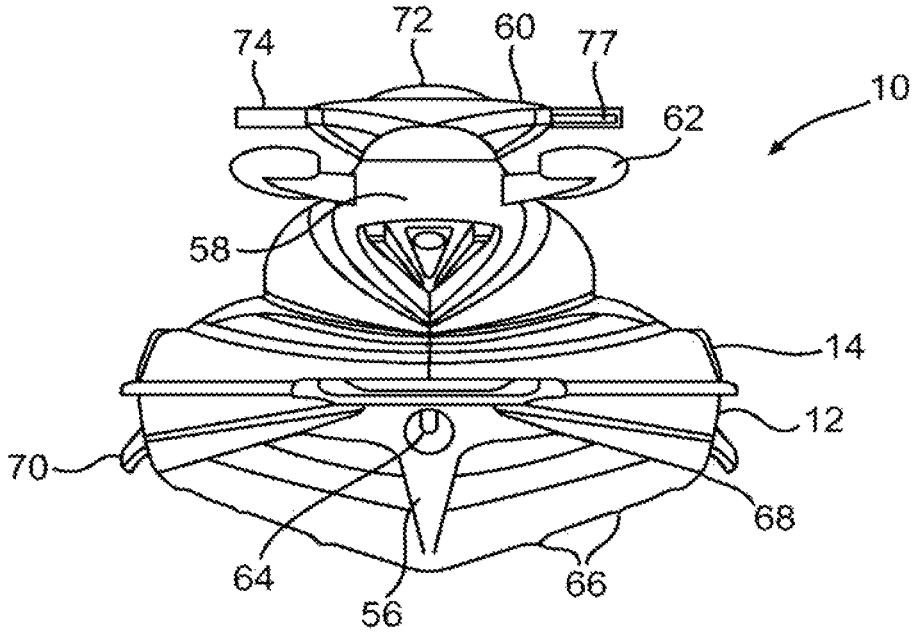
FIG. 3 is a front elevation view of the watercraft of FIG. 1.

Referring to the bow 56 of the watercraft 10, as seen in FIGS. 2 and 3, the watercraft 10 is provided with a hood 58 located forwardly of the seat 28 and a steering assembly including a helm assembly 60. A hinge (not shown) is attached between a forward portion of the hood 58 and the deck 14 to allow the hood 58 to move to an open position to provide access to the front storage bin 24 (FIG. 1). A latch (not shown) located at a rearward portion of hood 58 locks hood 58 into a closed position. When in the closed position, the hood 58 prevents water from entering front storage bin 24. Rear-view mirrors 62 are positioned on either side of hood 58 to allow the driver to see behind the watercraft 10. A hook 64 is located at the bow 56 of the watercraft 10. The hook 64 is used to attach the watercraft 10 to a dock when the watercraft 10 is not in use or to attach the watercraft 10 to a winch when loading the watercraft 10 on a trailer, for instance.

Figure 5:
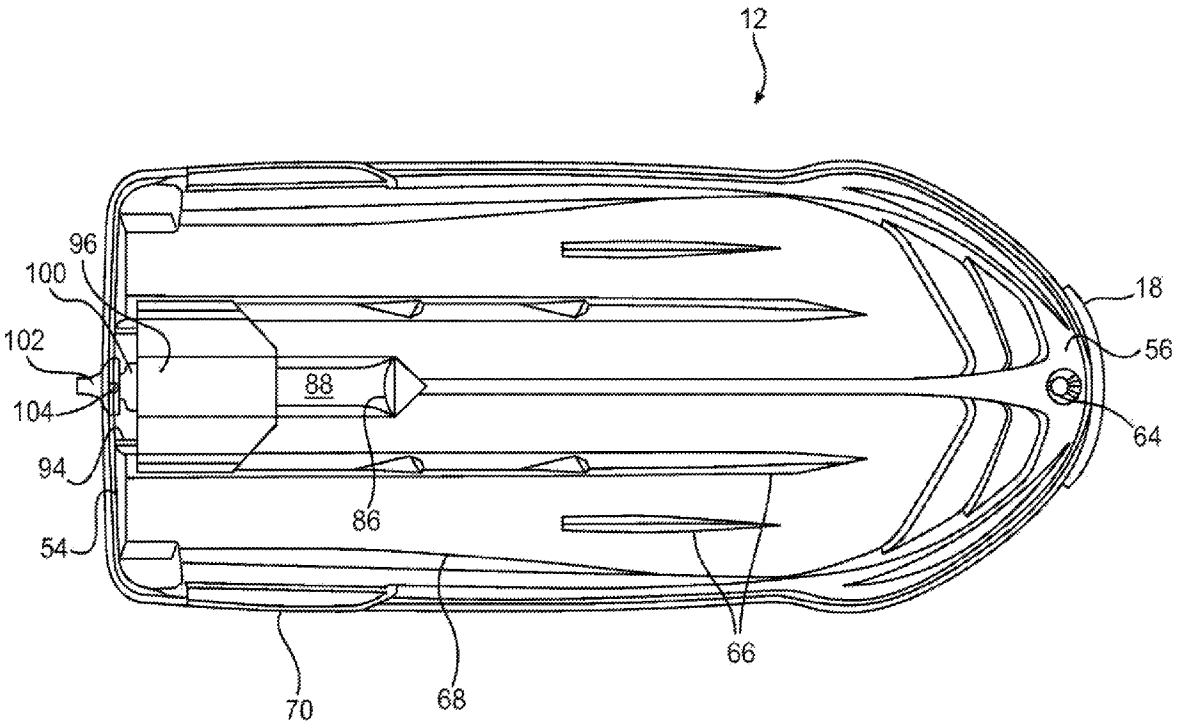
FIG. 5 is a bottom plan view of the hull of the watercraft of FIG. 1.

As best seen in FIGS. 3, 4, and 5, the hull 12 is provided with a combination of strakes 66 and chines 68. A strake 66 is a protruding portion of the hull 12. A chine 68 is the vertex formed where two surfaces of the hull 12 meet. The combination of strakes 66 and chines 68 provide the watercraft 10 with its riding and handling characteristics.

Sponsons 70 are located on both sides of the hull 12 near the transom 54. The sponsons 70 have an arcuate undersurface that gives the watercraft 10 both lift while in motion and improved turning characteristics. The sponsons 70 are fixed to the surface of the hull 12 and can be attached to the hull 12 by fasteners or molded therewith. It is contemplated that the position of the sponsons 70 could be adjusted with respect to the hull 12 to change the handling characteristics of the watercraft 10 and accommodate different riding conditions.

As best seen in FIGS. 3 and 4, the helm assembly 60 is positioned forwardly of the seat 28. The helm assembly 60 has a central helm portion 72, which may be padded, and a pair of steering handles 74, also referred to as a handlebar. One of the steering handles 74 is provided with a throttle operator 76, which allows the rider to control the engine 22, and therefore the speed of the watercraft 10. The throttle operator 76 can be in the form of a thumb-actuated throttle lever (as shown), a finger-actuated throttle lever, or a twist grip. The throttle operator 76 is movable between an idle position and multiple actuated positions. The throttle operator 76 is biased towards the idle position, such that when the driver of the watercraft lets go of the throttle operator 76, it will move to the idle position. The other of the steering handles 74 is provided with a reverse operator in the form of a lever 77 used by the driver to make the watercraft 10 move in reverse as will be described in greater detail below. It is contemplated that the lever 77 could also be used to decelerate the watercraft 10.

As seen in FIG. 2, a display area or cluster 78 is located forwardly of the helm assembly 60. The display cluster 78 can be of any conventional display type, including a liquid crystal display (LCD), dials or LEDs (light emitting diodes). The central helm portion 72 has various buttons 80, which could alternatively be in the form of levers or switches that allow the rider to modify the display data or mode (speed, engine rpm, time . . . ) on the display cluster 78. Buttons 80 may also be used by the driver to control the jet propulsion system 84 as described in greater detail below.

The helm assembly 60 also has a key receiving post 82 (FIG. 4), located near a center of the central helm portion 72. The key receiving post 82 is configured to receive a key (not shown) that permits starting of the watercraft 10. The key is attached to a safety lanyard (not shown). It should be noted that the key receiving post 82 may be placed in any suitable location on the watercraft 10.

Returning to FIGS. 1 and 5, the watercraft 10 is generally propelled by a jet propulsion system 84. The jet propulsion system 84 pressurizes water to create thrust. The water is first scooped from under the hull 12 through an inlet 86, which has an inlet grate (not shown in detail). The inlet grate prevents large rocks, weeds, and other debris from entering the jet propulsion system 84, which may damage the system or negatively affect performance. Water flows from the inlet 86 through a water intake ramp 88. The top portion 90 of the water intake ramp 88 is formed by the hull 12, and a ride shoe (not shown in detail) forms its bottom portion 92. Alternatively, the intake ramp 88 may be a single piece or an insert to which the jet propulsion system 84 attaches. In such cases, the intake ramp 88 and the jet propulsion system 84 are attached as a unit in a recess in the bottom of hull 12.

Figure 8:
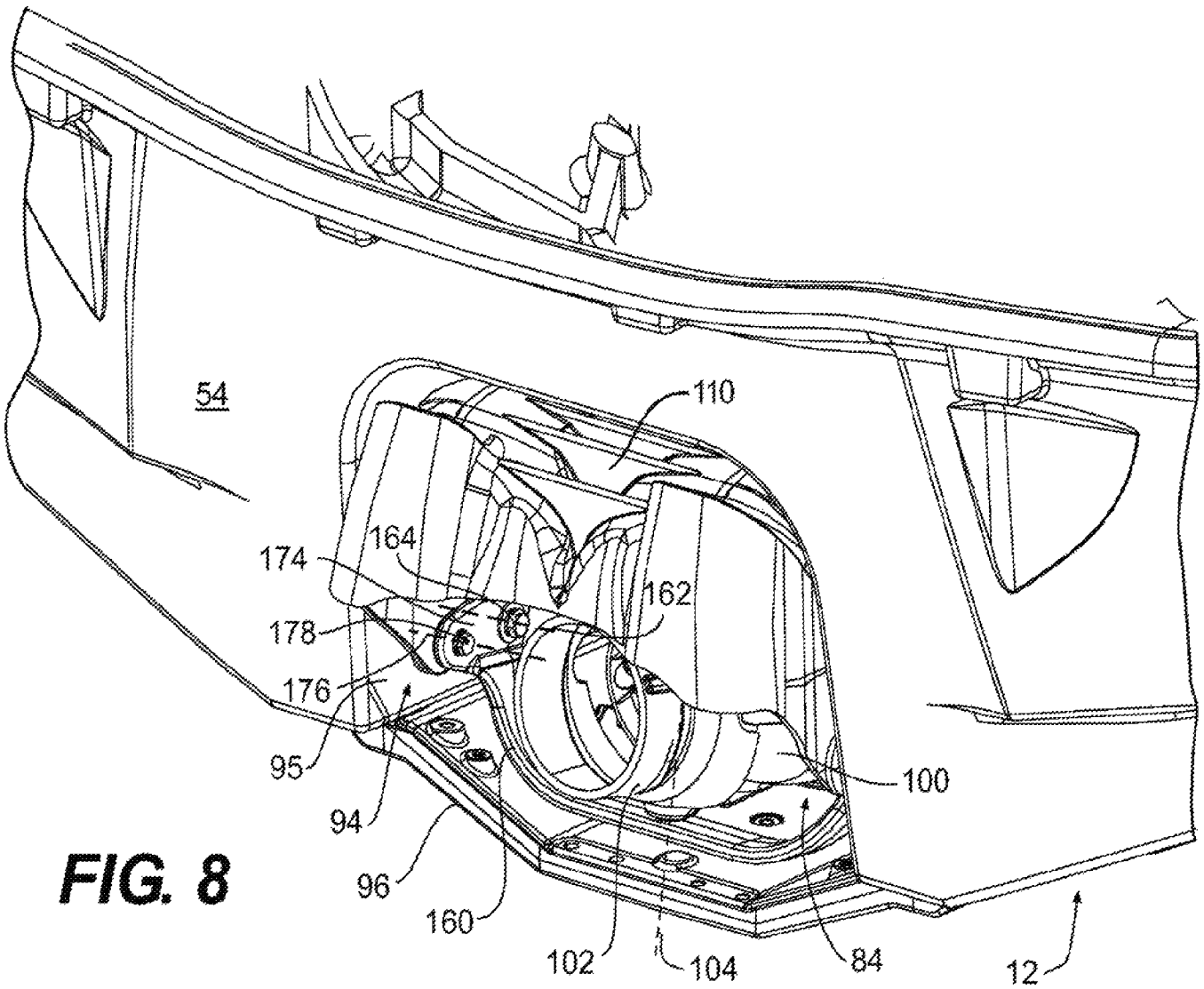
FIG. 8 is a perspective view, taken from a rear, right side, of a transom of the personal watercraft of FIG. 1.

From the intake ramp 88, water enters the jet propulsion system 84. As seen in FIG. 8, the jet propulsion system 84 is located in a formation in the hull 12, referred to as the tunnel 94. The tunnel 94 is defined at the front, sides, and top by walls 95 formed by the hull 12 (see FIG. 9) and is open at the transom 54. The bottom of the tunnel 94 is closed by a ride plate 96. The ride plate 96 creates a surface on which the watercraft 10 rides or planes at high speeds.

The jet propulsion system 84 includes a jet pump 99. The forward end of the jet pump 99 is connected to the front wall 95 of the tunnel 94. The jet pump 99 includes an impeller (not shown) and a stator (not shown). The impeller is coupled to the engine 22 by one or more shafts 98, such as a driveshaft and an impeller shaft. The rotation of the impeller pressurizes the water, which then moves over the stator that is made of a plurality of fixed stator blades (not shown). The role of the stator blades is to decrease the rotational motion of the water so that almost all the energy given to the water is used for thrust, as opposed to swirling the water. Once the water leaves the jet pump 99, it goes through a venturi 100 that is connected to the rearward end of the jet pump 99. Since the venturi's exit diameter is smaller than its entrance diameter, the water is accelerated further, thereby providing more thrust. A steering nozzle 102 is rotationally mounted relative to the venturi 100, as described in greater detail below, so as to pivot about a steering axis 104.

The steering nozzle 102 is operatively connected to the helm assembly 60 via a push-pull cable (not shown) such that when the helm assembly 60 is turned, the steering nozzle 102 pivots about the steering axis 104. This movement redirects the pressurized water coming from the venturi 100, so as to redirect the thrust and steer the watercraft 10 in the desired direction.

The jet propulsion system 84 is provided with a reverse gate 110 which is movable between a fully stowed position where it does not interfere with a jet of water being expelled by the steering nozzle 102 and a plurality of positions where it redirects the jet of water being expelled by the steering nozzle 102 as described in greater detail below. The reverse gate 110 is provided with flow vents 111 (FIG. 10) on either side thereof. When the steering nozzle 110 is in a lowered position and the steering nozzle 102 is turned left or right, a portion of the jet of water being expelled by the steering nozzle 102 flows through a corresponding one of the flow vents 111 thus creating a lateral thrust which assists in steering the watercraft 10. The specific construction of the reverse gate 110 will not be described in detail herein. It is contemplated that different types of reverse gate could be provided without departing from the present technology. One example of a suitable reverse gate is described in U.S. Pat. No. 6,533,623, issued on Mar. 18, 2003, the entirety of which is incorporated herein by reference.

When the watercraft 10 is moving, its speed is measured by a speed sensor 106 attached to the transom 54 of the watercraft 10. The speed sensor 106 has a paddle wheel 108 that is turned by the water flowing past the hull 12. In operation, as the watercraft 10 goes faster, the paddle wheel 108 turns faster in correspondence. This speed is referred to as "speed over water". An electronic control unit (ECU) 228 (FIG. 21) connected to the speed sensor 106 converts the rotational speed of the paddle wheel 108 to the speed of the watercraft 10 in kilometers or miles per hour, depending on the rider's preference. The speed sensor 106 may also be placed in the ride plate 96 or at any other suitable position. Other types of speed sensors, such as pitot tubes, and processing units could be used. Alternatively, a global positioning system (GPS) unit could be used to determine the speed of the watercraft 10 by calculating the change in position of the watercraft 10 over a period of time based on information obtained from the GPS unit. This speed is referred to as "speed over land". A vessel's speed over water and speed over land will often differ since speed over land is not affected by water currents.

Figure 6:
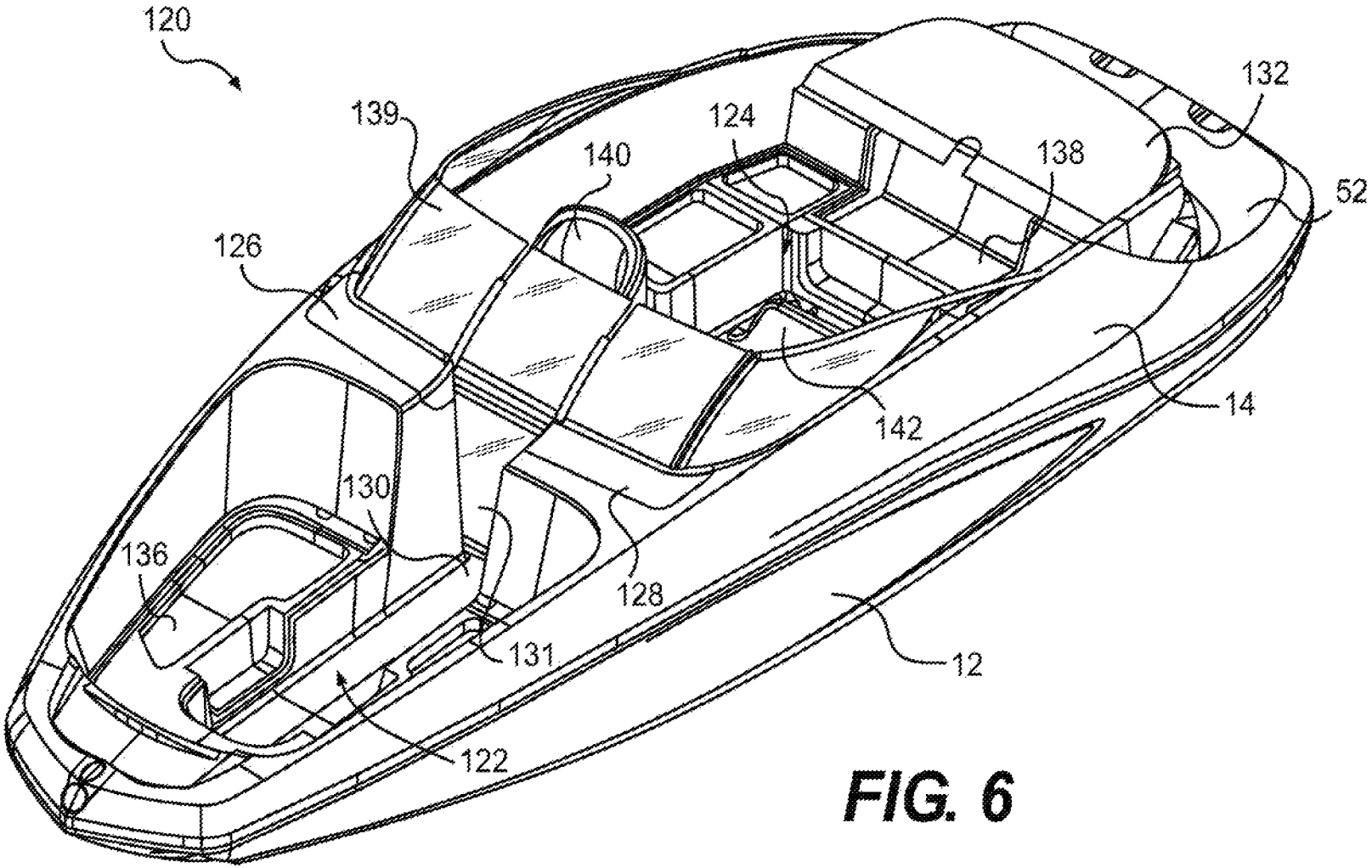
FIG. 6 is a perspective view, taken from a front, left side, of a jet propelled boat.
Figure 7:
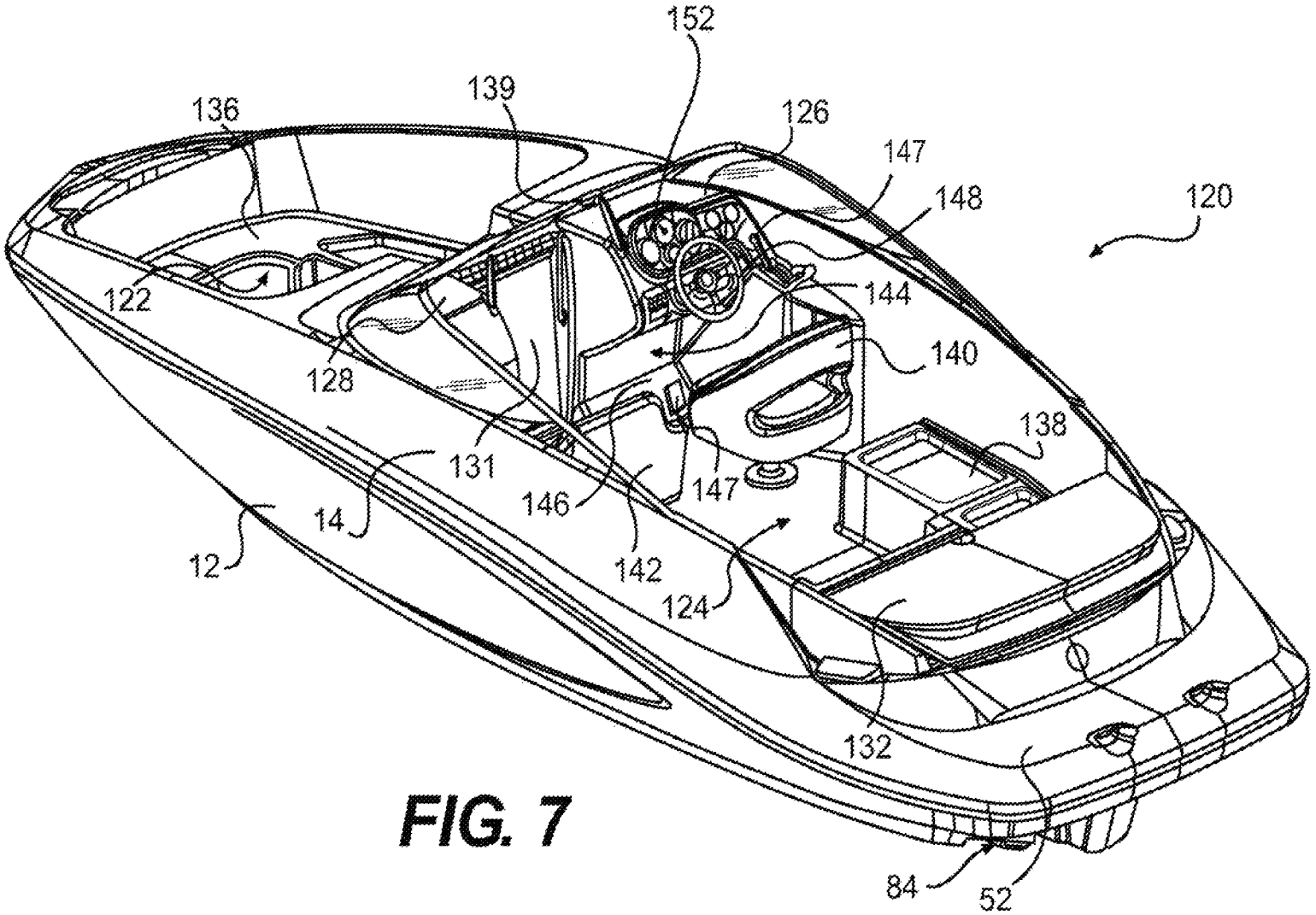
FIG. 7 is a perspective view, taken from a rear, left side, of the jet propelled boat of FIG. 6.

The general construction of a jet propelled boat 120 will now be described with respect to FIGS. 6 and 7. The following description relates to one way of manufacturing a jet propelled boat. Other known ways of manufacturing and designing jet propelled boats are contemplated.

For simplicity, the components of the jet propelled boat 120 which are similar in nature to the components of the personal watercraft 10 described above will be given the same reference numeral. Their specific construction may vary however.

The jet propelled boat 120 has a hull 12 and a deck 14 supported by the hull 12. The deck 14 has a forward passenger area 122 and a rearward passenger area 124. A right console 126 and a left console 128 are disposed on either side of the deck 14 between the two passenger areas 122, 124. A passageway 130 disposed between the two consoles 126, 128 allows for communication between the two passenger areas 122, 124. A door 131 is used to selectively open and close the passageway 130. At least one motor (not shown) is located between the hull 12 and the deck 14 at the back of the boat 120. In the present implementation, the at least one motor is at least one internal combustion engine. It is contemplated that the motor could be an electric motor or a combination of internal combustion engine and electric motor. The engine powers a jet propulsion system 84 of the boat 120. The jet propulsion system 84 is of similar construction as the jet propulsion system 84 of the personal watercraft 10 described above, and in greater detail below, and will therefore not be described in detail herein. It is contemplated that the boat 120 could have two engines and two jet propulsion systems 84. The engine is accessible through an engine cover 132 located behind the rearward passenger area 124. The engine cover 132 can also be used as a sundeck for a passenger of the boat 120 to sunbathe on while the boat 120 is not in motion. A reboarding platform 52 is located at the back of the deck 14 for passengers to easily reboard the boat 120 from the water.

The forward passenger area 122 has a C-shaped seating area 136 for passengers to sit on. The rearward passenger area 124 also has a C-shaped seating area 138 at the back thereof. A driver seat 140 facing the right console 126 and a passenger seat 142 facing the left console 124 are also disposed in the rearward passenger area 124. It is contemplated that the driver and passenger seats 140, 142 could swivel so that the passengers occupying these seats can socialize with passengers occupying the C-shaped seating area 138. A windshield 139 is provided at least partially on the left and right consoles 124, 126 and forwardly of the rearward passenger area 124 to shield the passengers sitting in that area from the wind when the boat 120 is in movement. The right and left consoles 126, 128 extend inwardly from their respective side of the boat 120. At least a portion of each of the right and the left consoles 126, 128 is integrally formed with the deck 14. The right console 126 has a recess 144 formed on the lower portion of the back thereof to accommodate the feet of the driver sitting in the driver seat 140 and an angled portion of the right console 126 acts as a footrest 146. The left console 128 has a similar recess (not shown) to accommodate the feet of the passenger sitting in the passenger seat 142. The right console 126 accommodates all of the elements necessary to the driver to operate the boat 120. These include, but are not limited to: a steering assembly including a steering wheel 148, a combined throttle and reverse operator in the form of a lever 147, and an instrument panel 152. The lever 147 combines the functions of the throttle operator 76 and the reverse operator 77 of the personal watercraft 10 into a single lever as will be described in greater detail below. It is contemplated that the lever 147 could only act as a throttle operator and that a second device, such as another lever or a pedal, could act as a reverse operator. The instrument panel 152 has various dials indicating the watercraft speed, motor speed, fuel and oil level, and engine temperature. The speed of the watercraft is measured by a speed sensor (not shown) which can be in the form of the speed sensor 106 described above with respect to the personal watercraft 10 or a GPS unit or any other type of speed sensor which could be used for marine applications. It is contemplated that the elements attached to the right console 126 could be different than those mentioned above. The left console 128 incorporates a storage compartment (not shown) which is accessible to the passenger sitting the passenger seat 142.

Turning now to FIGS. 8 to 20 the jet propulsion system 84 will be described. The jet propulsion system 84 being described is only one possible type of jet propulsion system and other types of jet propulsion systems are contemplated that would be encompassed by the present technology. As seen in FIG. 8, the jet propulsion system 84 is disposed in the tunnel 94 of the watercraft 10. It is contemplated that the jet propulsion system 84 could be mounted directly to the transom 54.

Figure 12:
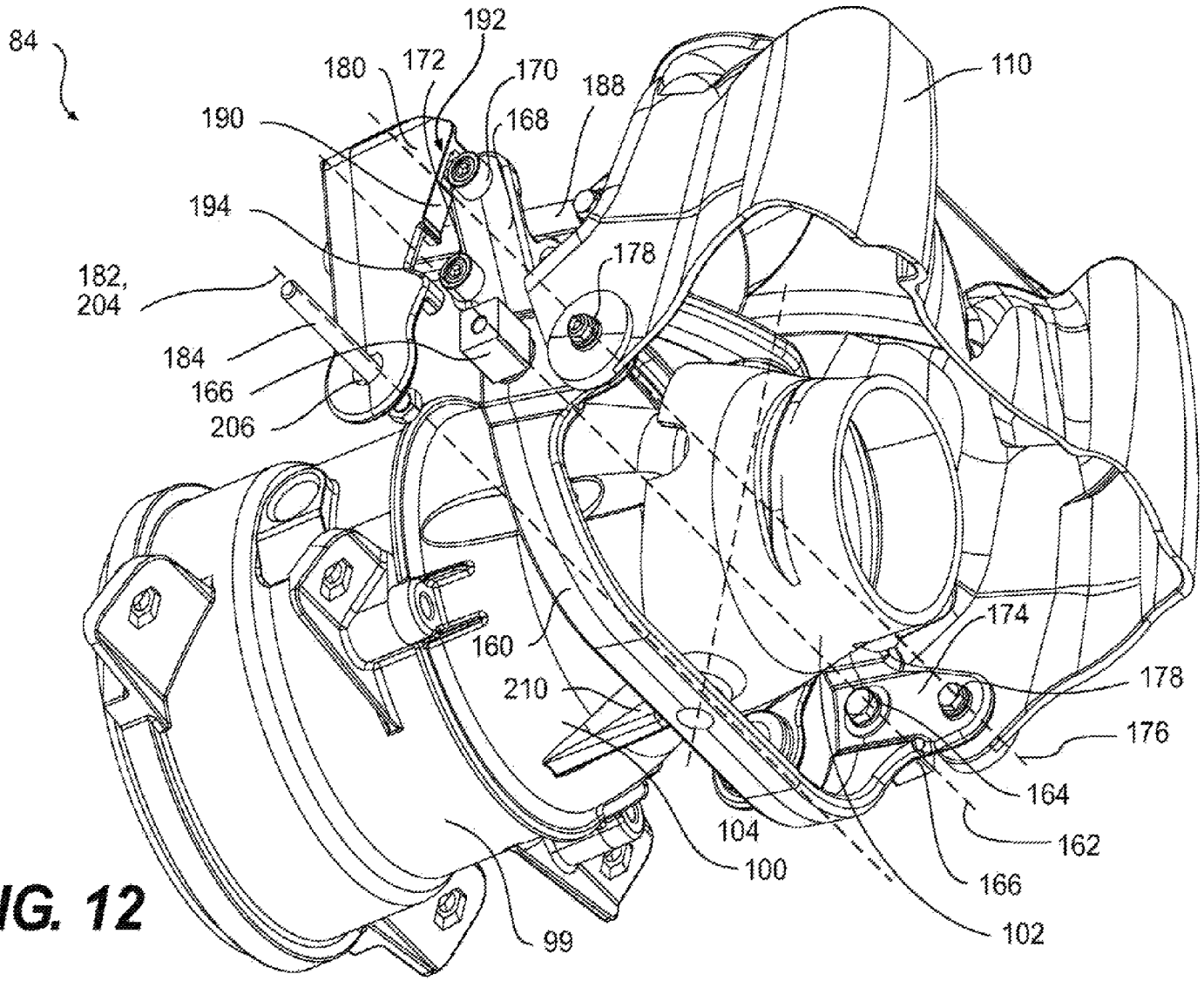
FIG. 12 is a bottom perspective view, taken from a rear, left side, of the jet propulsion system of FIG. 10 with the reverse gate in the stowed position.
Figure 13:
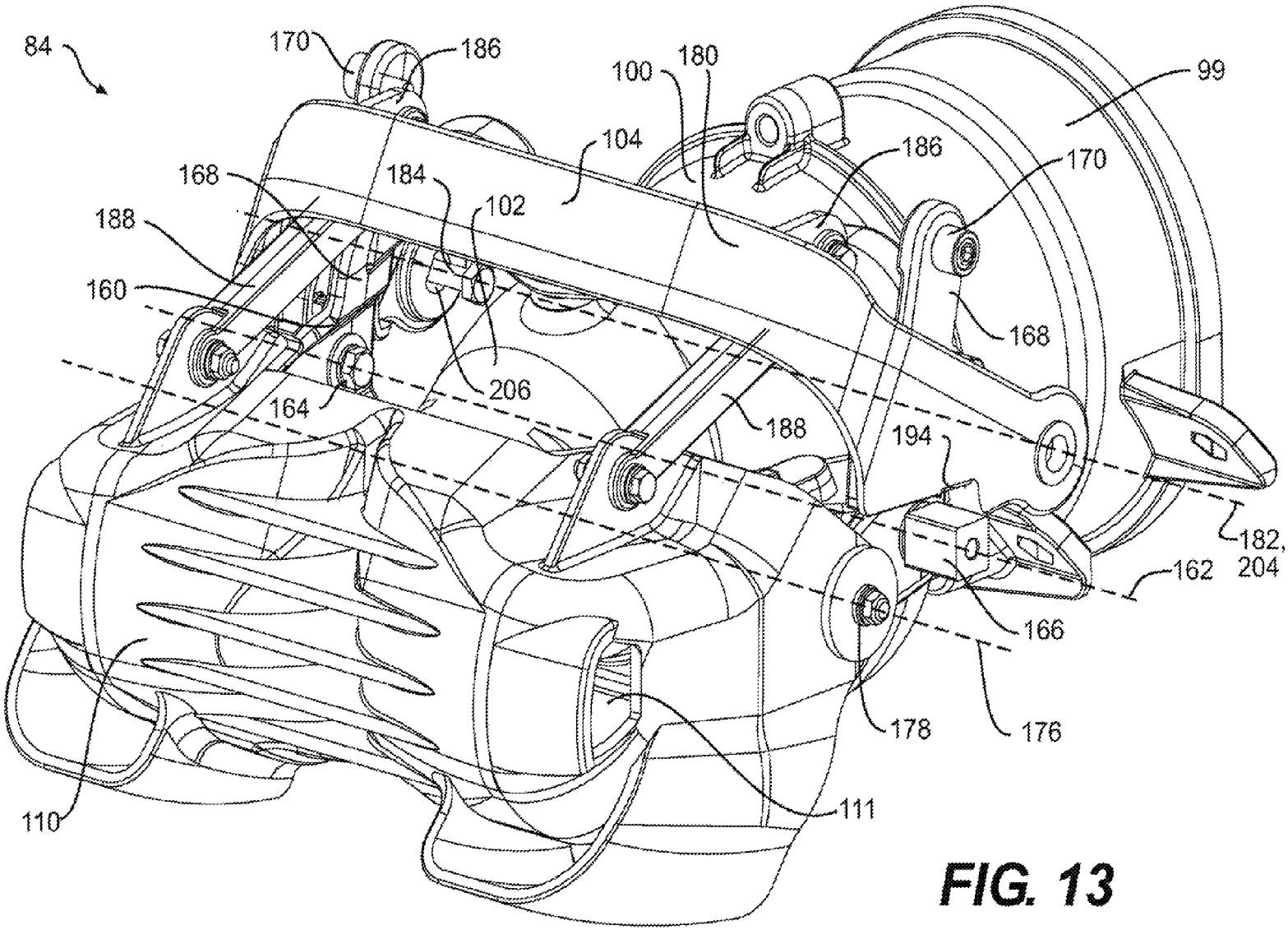
FIG. 13 is a perspective view, taken from a rear, right side, of the jet propulsion system of FIG. 10 with the reverse gate in a fully lowered position.

As previously mentioned, the jet propulsion assembly 84 includes a jet pump 99, a venturi 100, a steering nozzle 102, and a reverse gate 110. A variable trim system (VTS) support 160 is rotationally mounted to two side plates 161 (FIG. 11) which are mounted to the two side walls 95 of the tunnel 94 (see FIG. 8) about a VTS axis 162. The VTS axis 162 extends generally laterally and horizontally. Bolts 164 are used to connect the VTS support 160 to the side plates 161. Spacer blocks 166 are provided between the VTS support 160 and the side plates 161 to prevent the VTS support 160 from moving laterally inside the tunnel 94. The right side plate 161 has an exhaust connector 163 which connects to the exhaust system (not shown) of the watercraft to allow the exhaust gases to be exhausted inside the tunnel 94. It is contemplated that the VTS support 160 could be rotationally mounted about the VTS axis 162 directly on the venturi 100. As best seen in FIG. 12, the VTS support 160 is in the shape of a ring which encircles the forward portion of the steering nozzle 102. The steering nozzle 102 is rotationally mounted at a top and bottom of the VTS support 160 about the steering axis 104 such that the steering nozzle 102 rotates with the VTS support 160 about the VTS axis 162 as described below. The steering axis 104 is generally perpendicular to the VTS axis 162. As seen in FIGS. 10 to 20, the VTS support 160 has a pair of upwardly extending arms 168. A first guide pin 170 is disposed on each of the arms 168 at a position vertically higher than the VTS axis 162. A second guide pin 172 is disposed on each of the arms 168 at a position vertically higher than the VTS axis 162 and vertically lower than the first guide pin 170. The function of guide pins 170, 172 will be described below. The VTS support 160 also has a pair of rearwardly extending arms 174 to which the reverse gate 110 is rotationally mounted about a reverse gate axis 176 by nuts and bolts 178. The reverse gate axis 176 extends generally laterally and horizontally, and is disposed rearwardly of the VTS axis 162. It is contemplated that in alternative implementations, the reverse gate 110 could be movably connected the tunnel 94, an other portion of the hull 12 or the deck 14.

Figure 10:
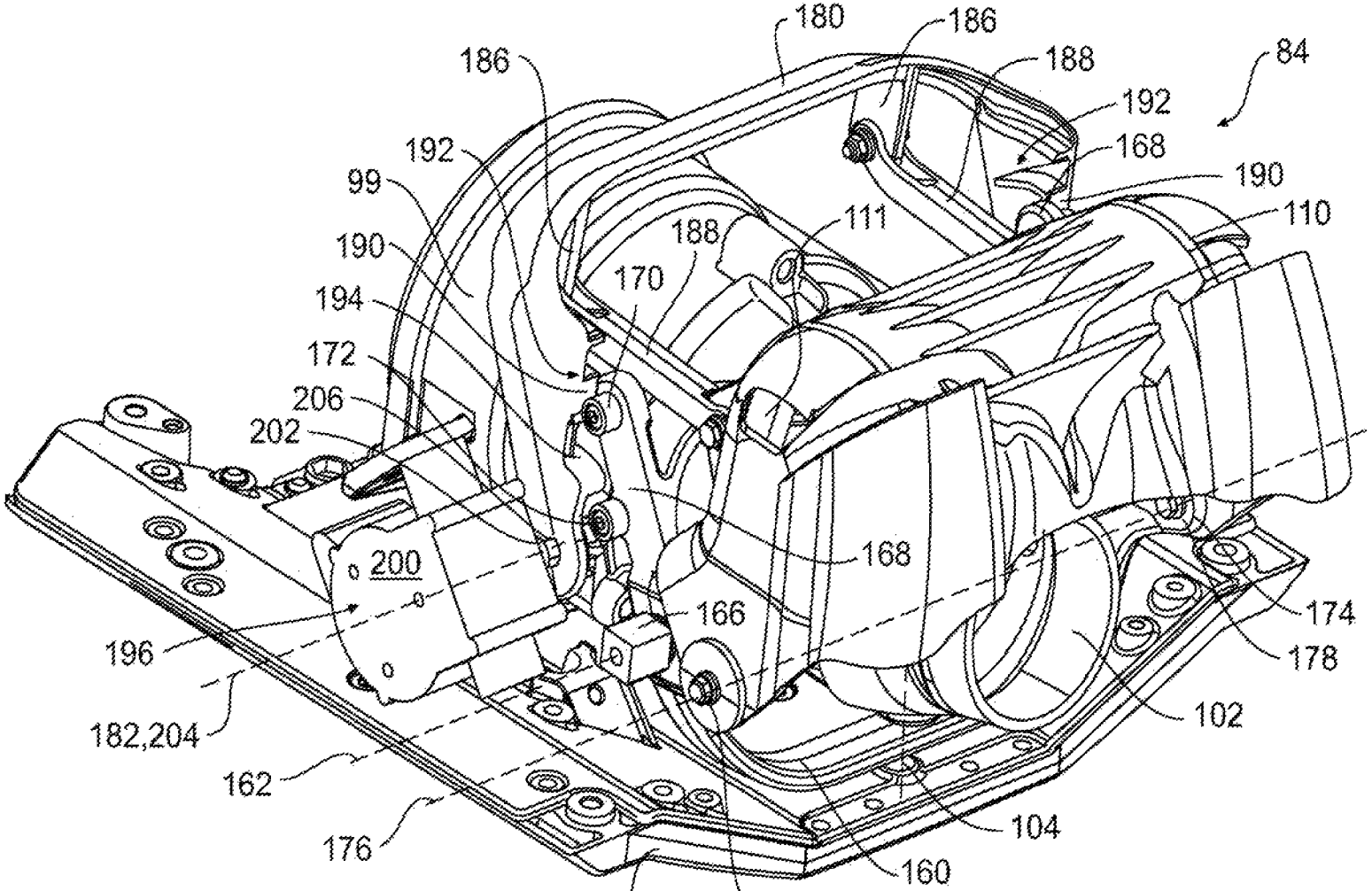
FIG. 10 is a perspective view, taken from a rear, left side, of a jet propulsion system with a reverse gate in a stowed position.
Figure 11:
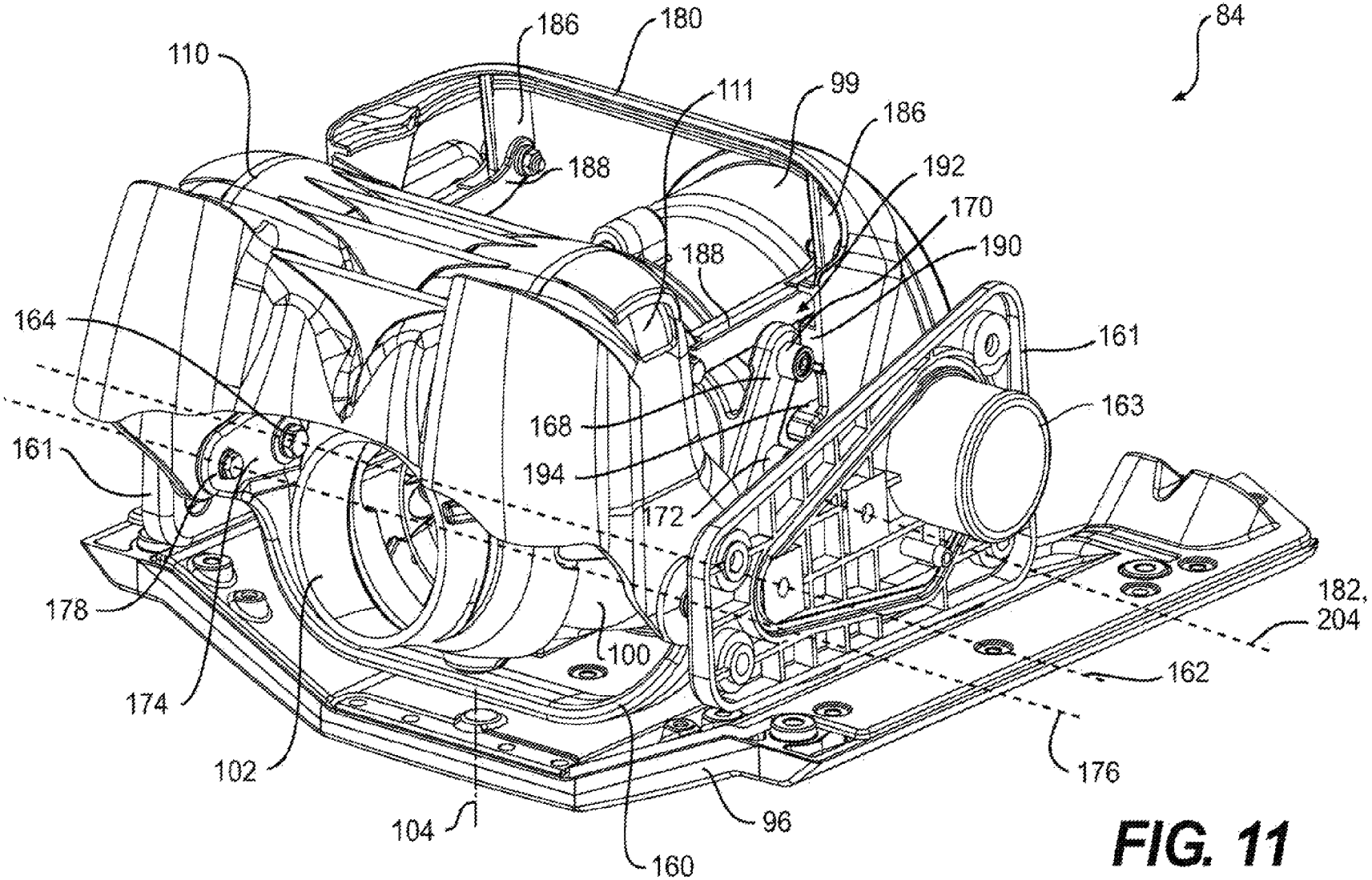
FIG. 11 is a perspective view, taken from a rear, right side, of the jet propulsion system of FIG. 10 with the reverse gate in the stowed position.

The jet propulsion system 84 is also provided with a main support 180 that is rotationally mounted to the two side plates 161 (FIG. 11) about a main support axis 182. The main support axis 182 extends generally laterally and horizontally. Bolts 184 (FIG. 12) are used to connect the main support 180 to the right side plate 161 and to the rotary actuator 196 (described below). The main support axis 182 is disposed forwardly of the VTS axis 162. It is contemplated that the main support 180 could be rotationally mounted about the main support axis 182 directly on the jet pump 99 or venturi 100. The main support 180 has an inverted U-shape. The upper portion of the main support 180 has a pair of downwardly extending tabs 186. Each tab 186 is pivotally connected to a first portion of a link 188 with a nut and a bolt. The second, opposite, portion of each link 188 is pivotally connected to the reverse gate 110 at a point vertically higher than the reverse gate axis 176 with a nut and a bolt. It is contemplated that only one or more than two tabs 186 and links 188 could be used. As best seen in FIG. 10, the main support 180 defines contact surfaces 190 on a rearwardly facing side thereof. As described in greater detail below, the first guide pins 170 contact the contact surfaces 190 in at least some arrangements of the VTS support 160 and the main support 180. As seen in FIGS. 10 and 17 to 20, the main support 180 also defines slots 192 therein which have an opening at an upper end of the contact surfaces 190. As described in greater detail below, the first guide pins 170 are disposed in the slots 192 in at least some arrangements of the VTS support 160 and the main support 180. As also seen in FIGS. 10 and 17 to 20, the main support 180 also defines ramps 194 which are disposed vertically below the slots 192 when the main support 180 is in the position shown in FIG. 17. The ramps 194 have an arcuate surface corresponding to a segment of a circle having the main support axis 182 as a center. As described in greater detail below, the second guide pins 172 contact the arcuate surfaces of the ramps 194 in at least some arrangements of the VTS support 160 and the main support 180.

Figure 9:
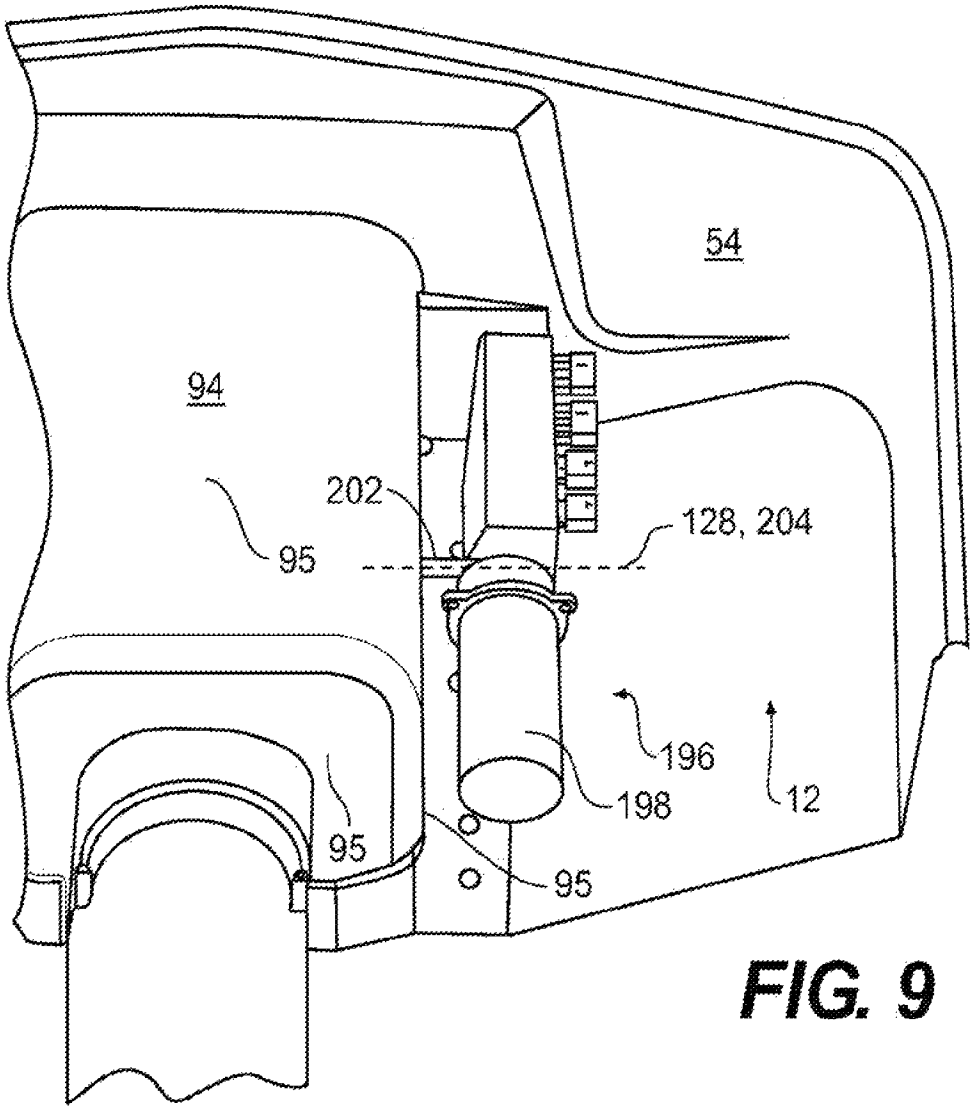
FIG. 9 is a top perspective view of a rear portion of the hull of the personal watercraft of FIG. 1.

As seen in FIGS. 9 and 10, the jet propulsion system 84 is provided with a reverse gate actuator in the form of a rotary actuator 196 disposed inside the hull 12 adjacent the left side wall 95 of the tunnel 94, thus limiting the exposure of the actuator 196 to water. The rotary actuator 196 includes a rotary electric motor 198 connected to a gear box 200 having an output portion 202. The gear box 200 transfers the rotation from an output shaft (not shown) of the rotary electric motor 198 to the output portion 202 which is perpendicular to the output shaft. It is contemplated that a power screw could be used to transfer the rotation from the output shaft of the rotary electric motor 198 to the output portion 202. It is also contemplated that a linear actuator could be used to actuate the reverse gate 110. The linear actuator could be mounted to the side wall 95 for example. One exemplary implementation of a linear actuator for actuating a reverse gate is described in U.S. patent application Ser. No. 14/473,335, filed Aug. 29, 2014, the entirety of which is incorporated herein by reference. The output portion 202 passes through the left side wall 95 and left side plate 161 and connects to the main support 180 so as to rotate the main support 180 about the main support axis 182 as described in greater detail below. The axis of rotation 204 of the output portion 202 is coaxial with the main support axis 182. The end of the output portion 202 has a flat part and fits inside a hole 206 in the main support 180 having a corresponding flat part so as to prevent relative rotation between the output portion 202 and the main support 180. It is contemplated that other ways of preventing relative rotation between the output portion 202 and the main support 180 could be used. It is also contemplated that other types of reverse gate actuators could be used, such as, for example, a hydraulic actuator. The rotary actuator 196 is controlled based on signals received from the ECU 228 as will be described below. The ECU 228 controls the power level applied to the rotary electric motor 198 of the rotary actuator 196. The rotary electric motor 198 rotates the output portion 202 faster as the power level applied increases. As the speed of rotation of the reverse gate 110 is proportional to the speed of rotation of the output portion 202, the speed of rotation of the reverse gate 110 increases as the power level applied to the rotary actuator 196 increases. In the present implementation, the signal supplied by the ECU 228 to the rotary actuator 196 to apply the power level is a pulse-width modulated signal resulting from a switch rapidly turning power on an off which results in an average power level between 0 and 100%. In the examples provided further below, the power level is expressed in terms of a percentage of pulse-width modulation (% PWM, also called "duty cycle") that indicates the percentage of time during which power, and more specifically voltage, is applied over the period of the signal. For example, a power level of 50% PWM indicates that power is applied 50% of the time. Therefore, the higher the % PWM, the faster the reverse gate 110 rotates. It is contemplated that other methods could be used to control the power level applied to the rotary actuator 196, such as, but not limited to, controlling a current level supplied to the rotary electric motor 198 of the rotary actuator 196.

Turning now to FIGS. 14 to 20, the operation of the jet propulsion system 84, and more specifically the movement of the main support 180, VTS support 160, steering nozzle 102, and reverse gate 110, will be described. FIGS. 14 to 20 only show some of the arrangements of these components and arrangements intermediate those shown are possible. For simplicity, the description will be made only with respect to the left side of the jet propulsion system 84. Although not specifically shown in these figures, a position of the output portion 202 of the rotary actuator 196 corresponds to a position of the main support 180. As such, when the main support 180 is shown as having been rotated by a certain number of degrees in one direction from one position to another, this rotation has been caused by the output portion 202 rotating by the same number of degrees in the same direction.

Figure 14:
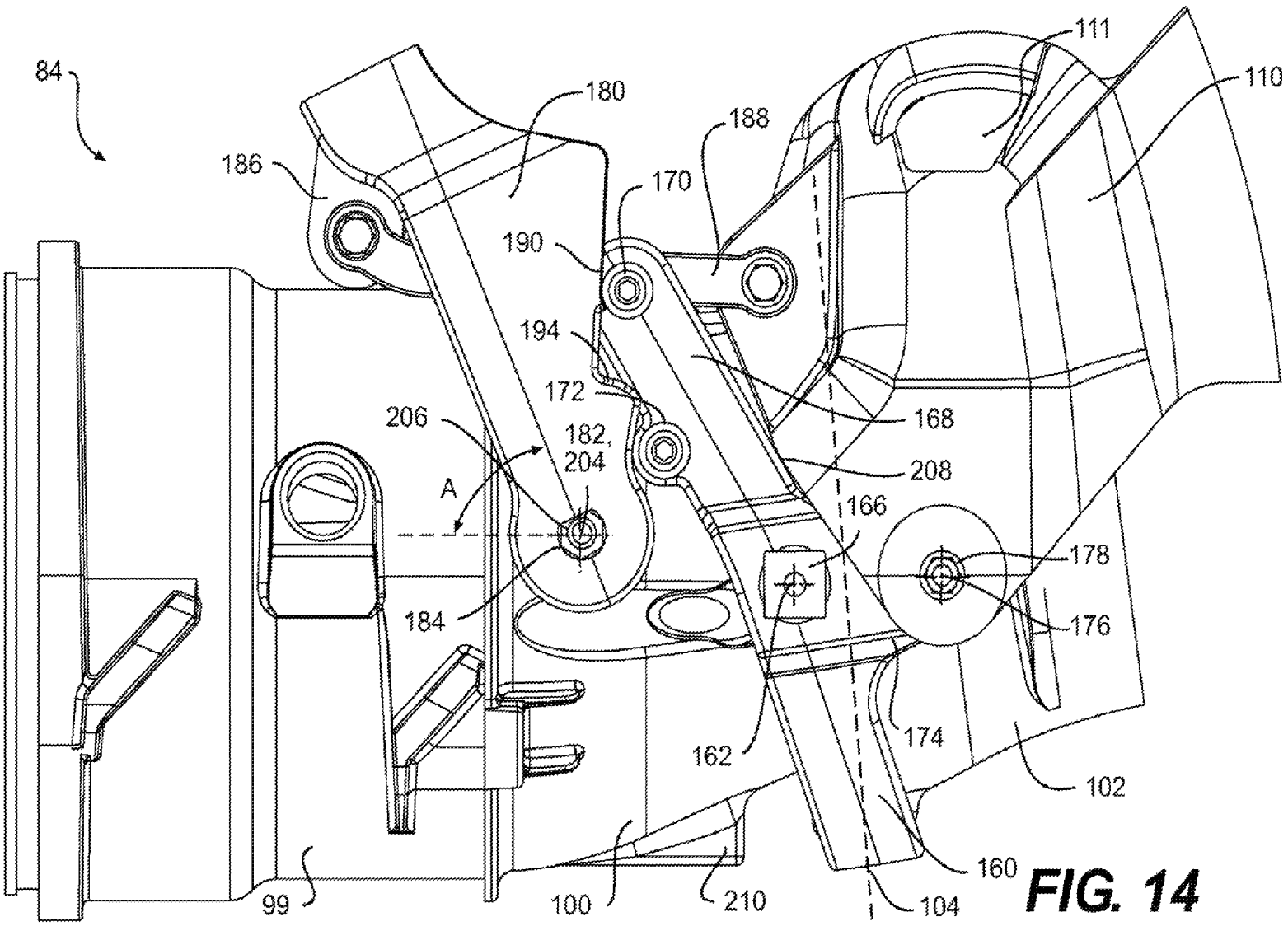
FIG. 14 is a left side view of the jet propulsion system of FIG. 10 with the variable trim system (VTS) in a VTS up position and the reverse gate in a fully stowed position.

In the arrangement shown in FIG. 14, the main support 180 is in a first position that is at an angle A from horizontal. The VTS support 160 is in a VTS up position where the steering nozzle 102 directs a jet of water from the venturi 100 slightly upwardly. The reverse gate 110 is in a fully stowed position. Unless the main support 180 is rotated by the output portion 202, the VTS support 160 is prevented from rotating counter-clockwise since the first guide pin 170 contacts the contact surface 190 and is prevented from rotating clockwise since the reverse gate 110 contacts a contact point 208 located vertically higher than the VTS axis 162 on the arm 168 of the VTS support 160. The reverse gate 110 is prevented from rotating clockwise by link 188.

Figure 15:
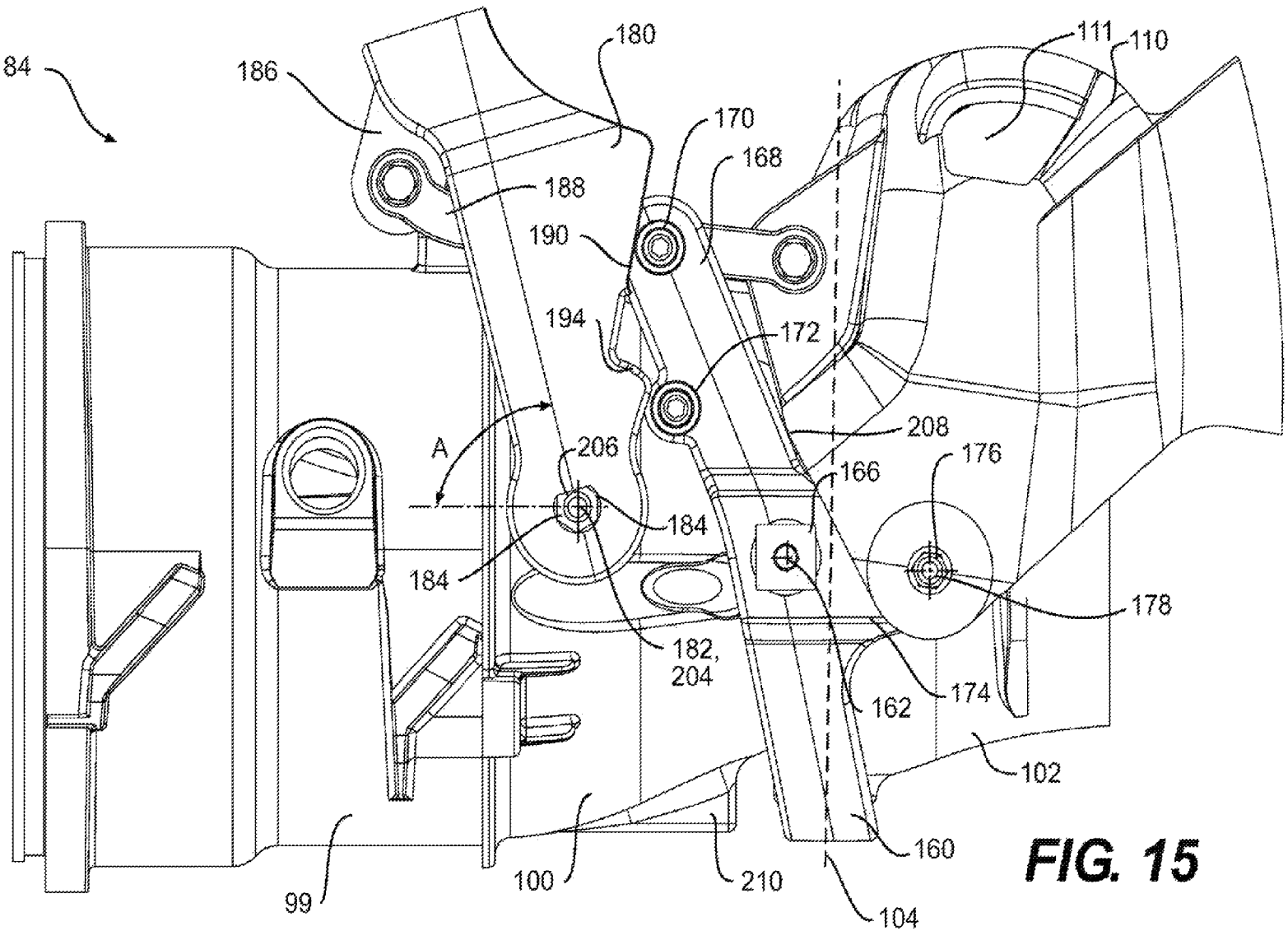
FIG. 15 is a left side view of the jet propulsion system of FIG. 10 with the VTS in a VTS neutral position and the reverse gate in a stowed position.
Figure 16:
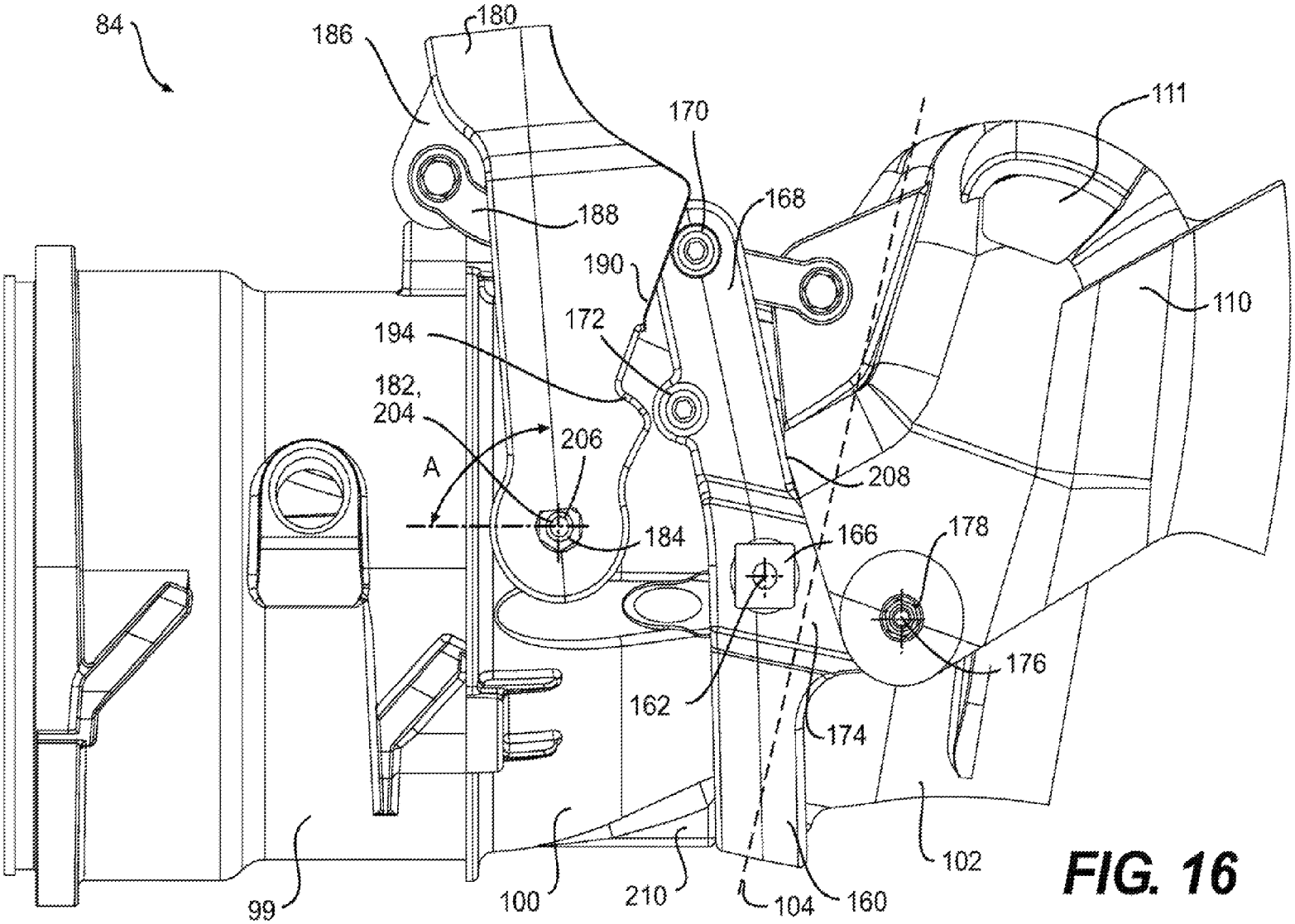
FIG. 16 is a left side view of the jet propulsion system of FIG. 10 with the VTS in a VTS down position and the reverse gate in a stowed position.
Figure 17:
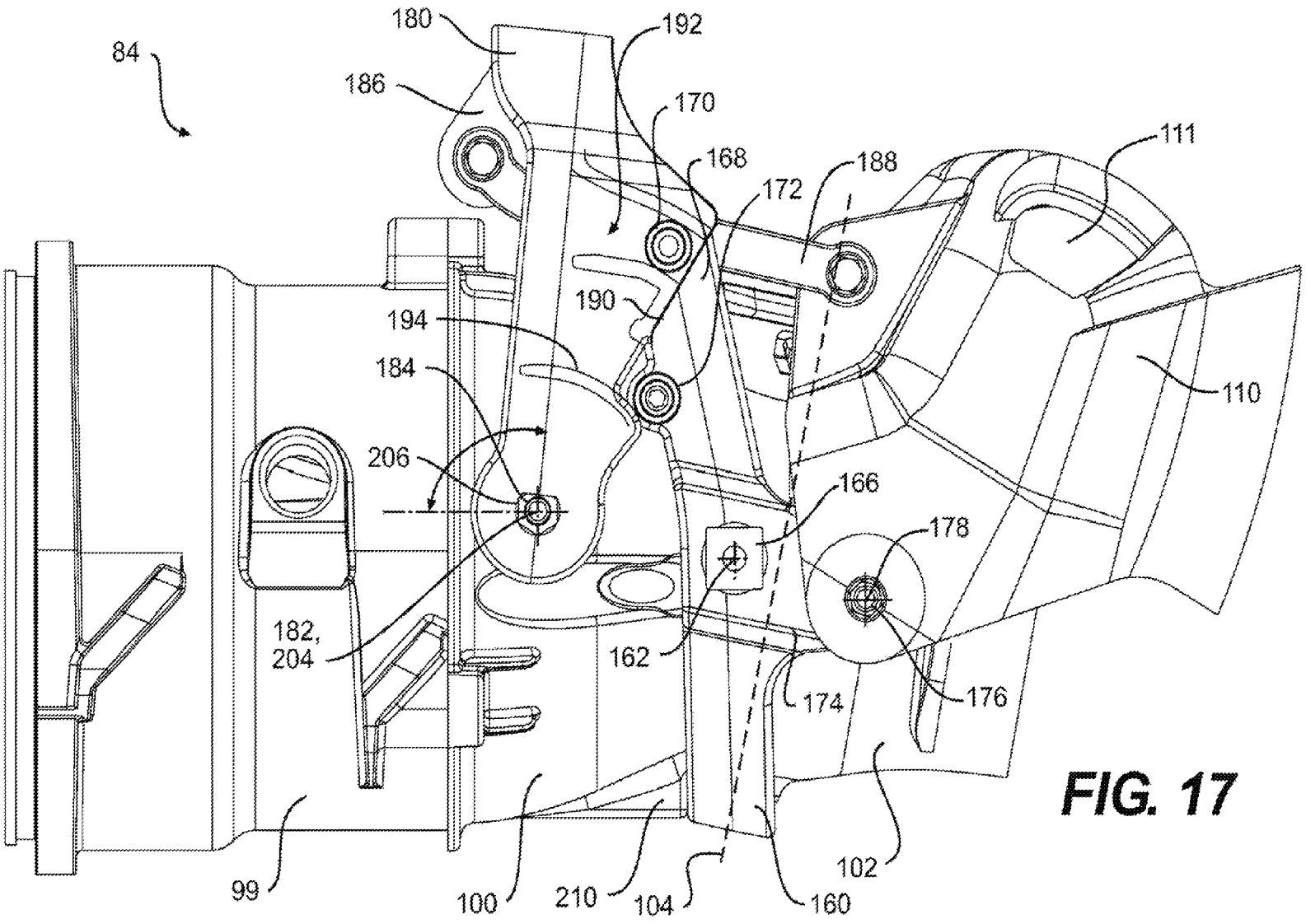
FIG. 17 is a left side view of the jet propulsion system of FIG. 10 with the VTS in a VTS down position and the reverse gate in a lowered position.
Figure 18:
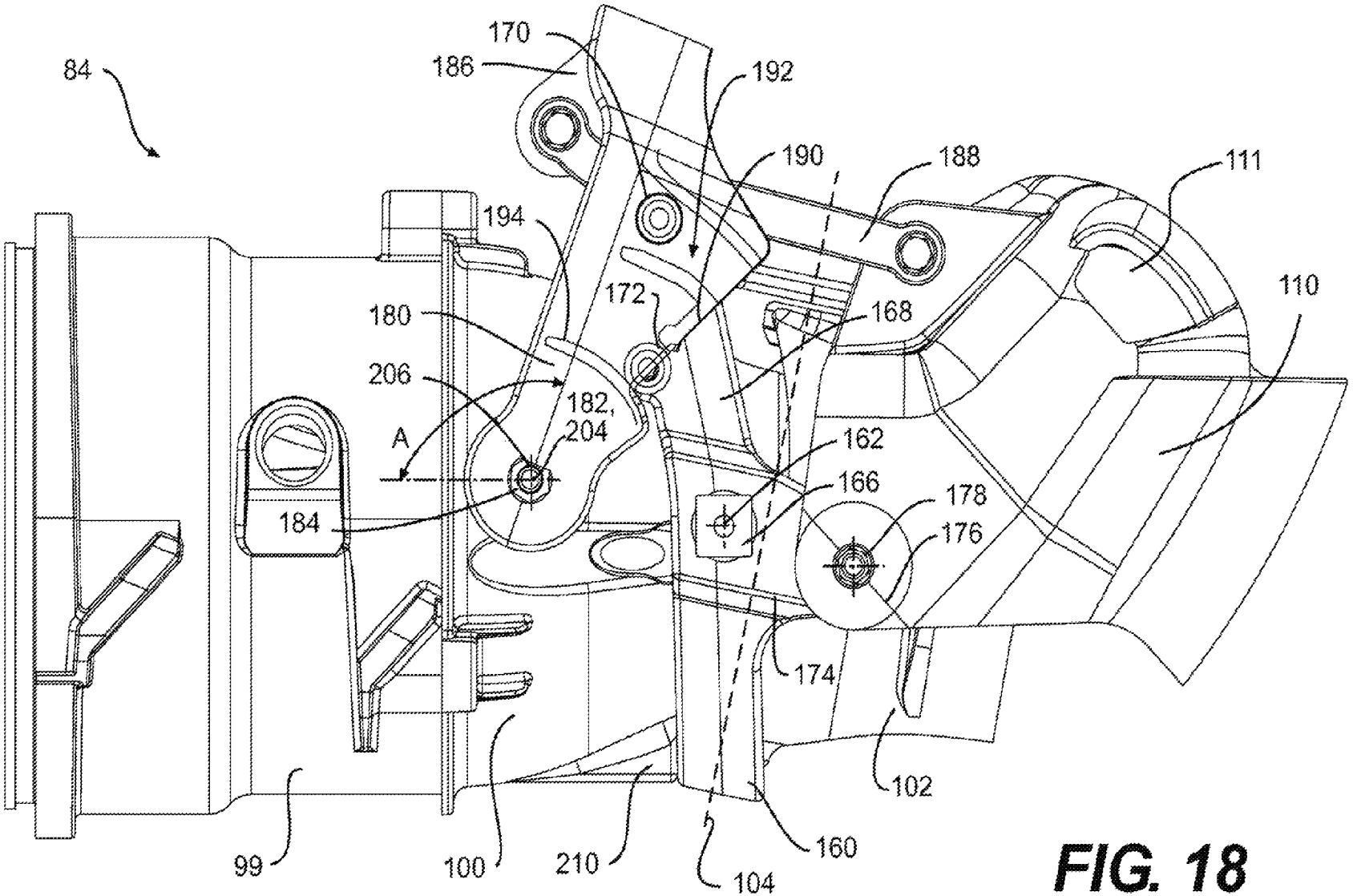
FIG. 18 is a left side view of the jet propulsion system of FIG. 10 with the VTS in a VTS down position and the reverse gate in a neutral position.
Figure 19:
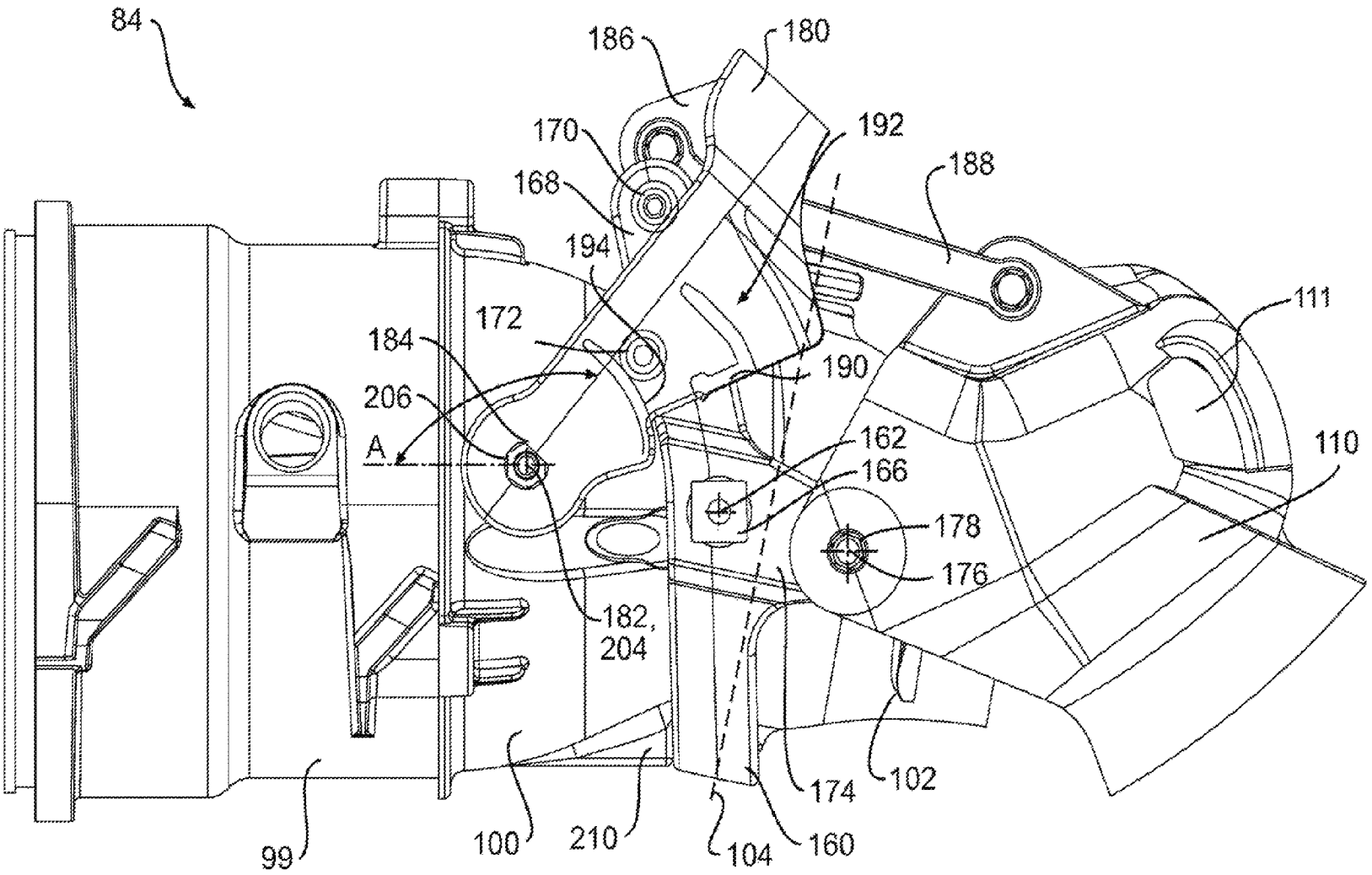
FIG. 19 is a left side view of the jet propulsion system of FIG. 10 with the VTS in a VTS down position and the reverse gate in a lowered position.

As the output portion 202 is rotated clockwise, the main support 180 also rotates clockwise about the main support axis 182 from the position shown in FIG. 14 to the position shown in FIG. 15, and then to the position shown in FIG. 16, and as such the angle A increases. As the main support 180 rotates, the guide pin 170 slides upwardly along the contact surface 190, causing the VTS support 160 to rotate clockwise about the VTS axis 162. As the VTS support 160 rotates clockwise from the position shown in FIG. 14 to the position shown in FIG. 16, the reverse gate axis 176, and therefore the reverse gate 110, moves in an arc about the VTS axis 162. As such, the position of the reverse gate 110 relative to the VTS support 160 remains substantially the same (i.e. a stowed position) and the reverse gate 110 continues to contact the contact point 208. Therefore, for each position of the main support 180 between the position shown in FIG. 14 and the position shown in FIG. 16 there is a single corresponding position of the VTS support 160 since the VTS support is held between the contact surface 190 (by first guide pin 170) and the reverse gate 110. In the arrangement shown in FIG. 15, the VTS support 160 is in a VTS neutral position where the steering nozzle 102 directs a jet of water from the venturi 100 generally parallel to the central axis of the venturi 100, and the reverse gate 110 is in a stowed position. In the arrangement shown in FIG. 16, the VTS support 160 is in a VTS down position where the steering nozzle 102 directs a jet of water from the venturi 100 slightly downwardly, and the reverse gate 110 is in a stowed position.

As the output portion 202 continues to be rotated clockwise, the main support 180 also continues to rotate clockwise about the main support axis 182 from the position shown in FIG. 16 to the positions shown in FIGS. 17 to 20 consecutively, and as such the angle A continues to increase. Since, as shown in FIGS. 16 to 20, the bottom portion of the VTS support 160 contacts a stopper portion 210 of the venturi 100, to permit the continued rotation of the main support 180 the first guide pin 170 enters slot 192. The VTS support 160 is maintained in the VTS down position in the arrangements shown in FIGS. 17 to 20 by having the second guide pin 172 contact the arcuate surface of the ramp 194, thus preventing counter-clockwise rotation of the VTS support 160 about the VTS axis 162, which would otherwise occur due to the force of the water jet on the steering nozzle 102. Since the VTS support 160 is maintained in the VTS down position, the reverse gate axis 176 remains in position. Therefore, as the main support 180 is rotated clockwise, the link 188 pushes on the reverse gate 110 which no longer contacts the contact point 208 and rotates about the reverse gate axis 176 to the positions shown in FIGS. 17 to 20 consecutively. In the positions shown in these figures, the reverse gate 110 redirects the jet of water expelled from the steering nozzle 102. In the position shown in FIG. 18, the reverse gate 110 is in a neutral position and the jet of water is redirected generally downwardly and as such the jet of water does not thrust the watercraft forward or backward. In the position shown in FIG. 20, most of the jet of water is redirected towards a front of the watercraft which causes the watercraft to decelerate or move in the reverse direction.

In summary, as the output portion 202 of the rotary actuator 196 rotates the main support 180 from the position shown in FIG. 14 to the position shown in FIG. 16, the VTS support 160 rotates from the VTS up position to the VTS down position, while the reverse gate 110 remains in the stowed position. As the output portion 202 of the rotary actuator 196 continues to rotate the main support 180 from the position shown in FIG. 16 to the position shown in FIG.

20, the reverse gate 110 rotates about the reverse gate axis 176 to redirect the jet of water being expelled from the steering nozzle 102, while the VTS support 160 remains in the VTS down position.

Figure 20:
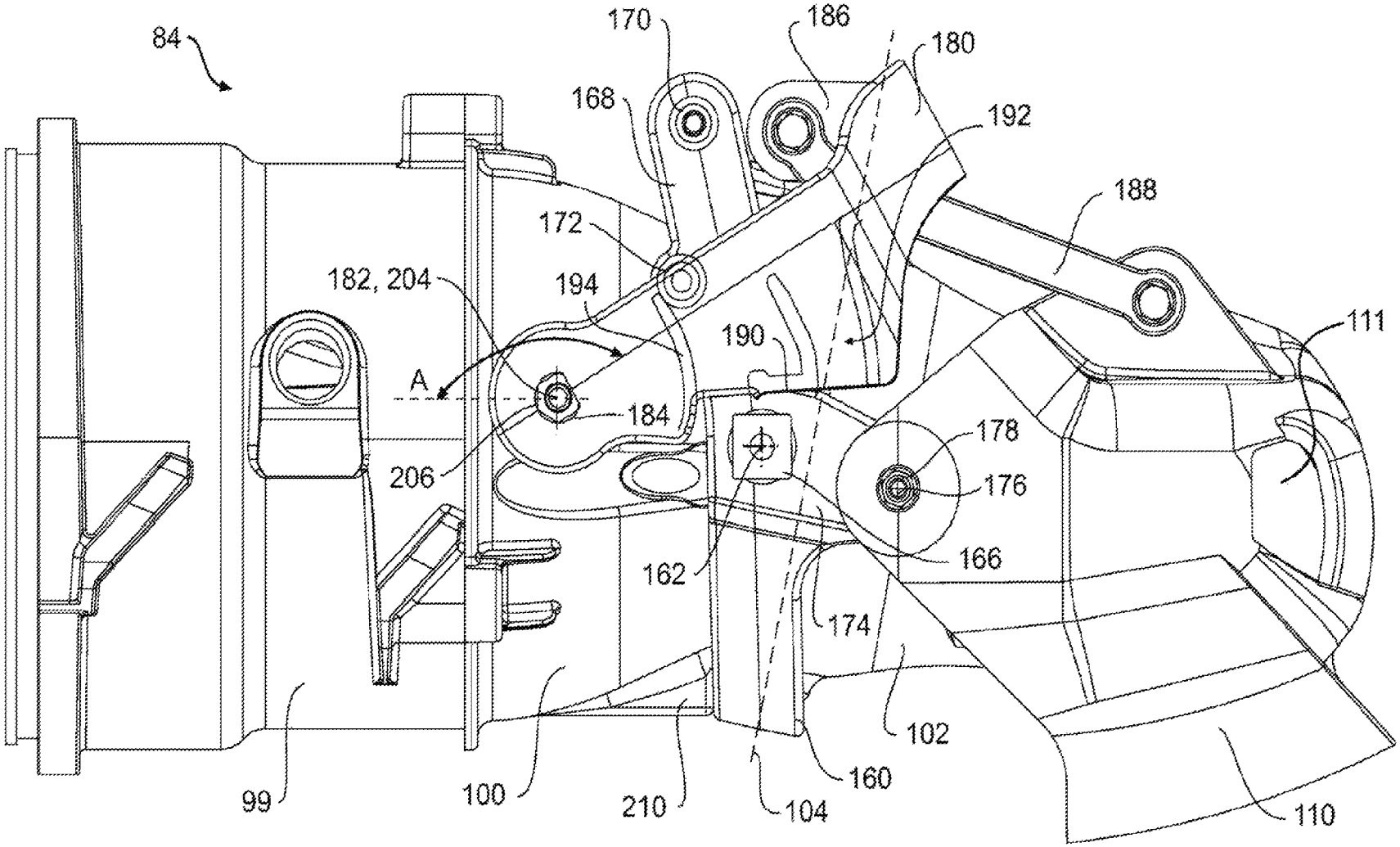
FIG. 20 is a left side view of the jet propulsion system of FIG. 10 with the VTS in a VTS down position and the reverse gate in a fully lowered position.

From FIG. 20, when the output portion 202 rotates counter-clockwise, the main support 180 rotates counter-clockwise, the link 188 pulls on the reverse gate 110 causing it to rotate counter-clockwise about the reverse gate axis 176, and the VTS support 106 remains fixed in the VTS down position until the position shown in FIG. 16. As the output portion 202 continues to rotate counter-clockwise from the position shown in FIG. 16, the reverse gate 110 contacts the contact point 208 and continues to be pulled by the link 188 causing the VTS support 160 to rotate counter-clockwise about the VTS axis 162, and the reverse gate 110 remains in the stowed position relative to the steering nozzle 102. The direction of rotation of the output portion 202 can be changed at any time (i.e. it does not need to be rotated from the position shown in FIG. 14 to the position shown in FIG. 20 before it can be rotated counter-clockwise, and vice versa). It is contemplated that the rotation of the output portion 202 could be stopped at any time to maintain a desired arrangement of the components.

It is contemplated that the rotary actuator 196 could be operatively connected to the VTS support 160 and the reverse gate 110 via components other than the main support 180 and still operate as described above. For example, it is contemplated that a system of cams and/or gears could be used.

Figure 21:
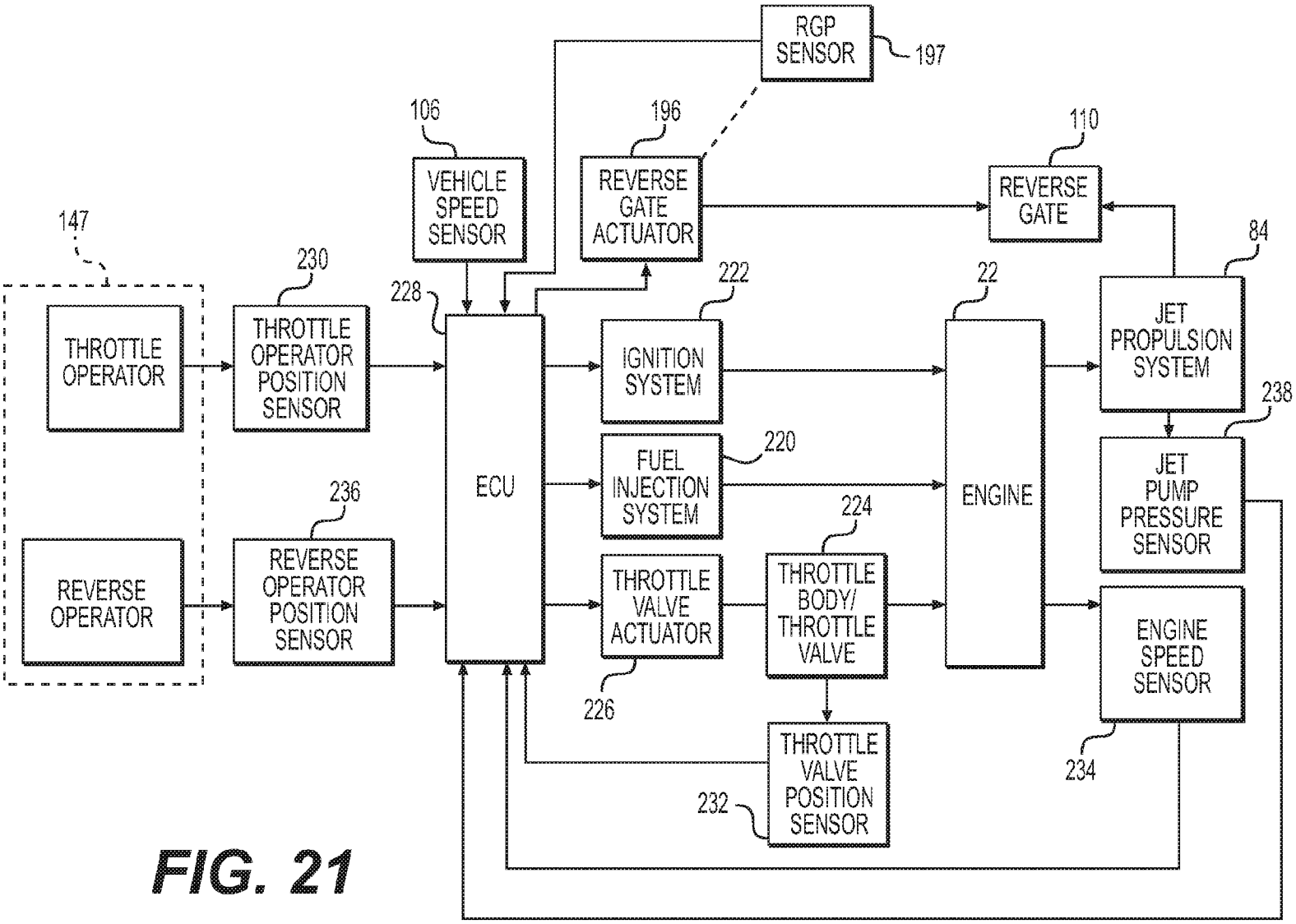
FIG. 21 is a schematic representation of some of the sensors and vehicle components present in a watercraft in accordance with the present technology.

Turning now to FIG. 21, the various sensors and vehicle components present in a watercraft in accordance with the present technology, such as those described above, will now be described. It is contemplated that not every sensor or component illustrated in FIG. 21 is required to achieve aspects of the present technology. It is also contemplated that, depending on the particular aspect of the technology, some of the sensors and components could be omitted, some of the sensors and components could be substituted by other types of sensor and components, and two or more sensors could be combined in a single sensor that can be used to perform multiple functions without departing from the scope of the present technology. Also, it is contemplated that the ECU 228 could be a single or a combination of multiple electronic controllers. For example, it is contemplated that one control unit could be used to control the engine 22 and its associated components and that another control unit could be used to control the reverse gate actuator 196. For simplicity, the sensors and components will be described with reference to the jet propelled boat 120. The personal watercraft 10 is provided with the same or similar sensors and components.

As can be seen in FIG. 21, the engine 22 has a fuel injection system 220 and an ignition system 222 to control the amount of fuel provided to the engine 22 and combustion of a fuel/air mixture respectively. A throttle body having a throttle valve 224 controls the amount of air provided to the engine 22. A throttle valve actuator 226, in the form of an electric motor, is connected to the throttle valve 224 to move the throttle valve 224 to a desired position. The ECU 228, which is disposed in the watercraft 120 and used to control the operation of various elements of the watercraft 120, is in electronic communication with various sensors from which it receives signals. The ECU 228 uses these signals to control the operation of the ignition system 222, the fuel injection system 220, and the throttle valve actuator 226 in order to control the engine 22.

A throttle operator position sensor 230 senses a position of the lever 147 (i.e. the combined throttle and reverse operator) and sends a throttle signal representative of the lever position to the ECU 228. The throttle operator position sensor 230 transmits a voltage corresponding to the sensed position of the lever 147 to the ECU 228. It is contemplated that the throttle operator position sensor 230 could be any type of sensor, such as a magnetic position sensor, a rheostat or a potentiometer which regulates voltage instead of current. As would be understood, some type of sensors would send a current corresponding to the sensed position of the lever 147 to the ECU 228 instead of a voltage. In the personal watercraft 10, the throttle operator position sensor 230 senses a position of the throttle operator 76.

The vehicle speed sensor 106 senses the speed of the vehicle, whether speed over water or speed over land, and sends a signal representative of the speed of the vehicle to the ECU 228. The ECU 228 sends a signal to a speed gauge located in the instrument panel 152 of the boat 120 such that the speed gauge displays the watercraft speed to the driver of the boat 120.

A throttle valve position sensor 232 senses the position (i.e. the degree of opening) of the throttle valve 224 and sends a signal representative of the position of the throttle valve 224 to the ECU 228. The ECU 228 uses the signal received from the throttle valve position sensor 232 as a feedback to determine if the throttle valve actuator 226 has moved the throttle valve 224 to the desired position and can make adjustments accordingly. The ECU 228 can also use the signal from the throttle valve position sensor 232 actively to control the ignition system 222 and the fuel injection system 220 along with other signals depending on the specific control scheme used by the ECU 228. The throttle valve position sensor 232 can be any suitable type of sensor such as a rheostat and a potentiometer. Depending on the type of throttle valve actuator 226 being used, a separate throttle valve position sensor 232 may not be necessary. For example, a separate throttle valve position sensor 232 would not be required if the throttle valve actuator 226 is a servo motor since servo motors integrate their own feedback circuit that corrects the position of the motor and thus have an integrated throttle position sensor 232.

An engine speed sensor 234 senses a speed of rotation of the engine 22 and sends a signal representative of the speed of rotation of the engine 22 to the ECU 228. Typically, an engine, such as the engine 22, has a toothed wheel disposed on and rotating with a shaft of the engine, such as the crankshaft or output shaft. The engine speed sensor 234 is located in proximity to the toothed wheel and sends a signal to the ECU 228 each time a tooth passes in front it. The ECU 228 can then determine the motor speed by calculating the time elapsed between each signal.

A reverse operator position sensor 236 senses a position of the lever 147 (i.e. the combined throttle and reverse operator) and sends a reverse gate position request signal indicative of the lever position to the ECU 228. The reverse operator position sensor 236 can be any suitable type of sensor such as a magnetic position sensor, a rheostat and a potentiometer. The reverse gate position request signal received from the reverse operator position sensor 236 by the ECU 228 is used by the ECU 228 to control the reverse gate actuator 196 and therefore the position of the reverse gate 110 as will be described below. It is contemplated that the reverse operator position sensor 236 could send its reverse gate position request signal to a dedicated electronic control unit that is physically separate from a main ECU and that this dedicated electronic control unit would control the reverse gate actuator 196. In such an implementation, the dedicated ECU and the main ECU together form at least part of the ECU 228. It is contemplated that the reverse operator position sensor 236 and the throttle operator position sensor 230 could be a single sensor sensing a position of the lever 147. In the personal watercraft 10, the reverse operator position sensor senses a position of the reverse operator 77.

A jet pump pressure sensor 238 senses a water pressure present in the jet pump 99 of the jet propulsion system 84. The jet pump pressure sensor 238 can be in the form of a pitot tube, but other types of pressure sensors are contemplated. The jet pump pressure sensor 238 sends a signal representative of the jet pump pressure to the ECU 228. The pressure in the jet pump 99 is representative of the amount of thrust being generated by the jet propulsion system 84. The jet pump pressure sensor 238 is used as a feedback to the ECU 228 to determine if a thrust request sent to the engine 22 by the ECU 228 has resulted in a corresponding drop or increase in jet pump pressure. The jet pump pressure sensor 238 can also be used to determine if the jet pump 99 operates properly. For example, a jet pump pressure that is lower than expected could indicate that the inlet of the jet pump 99 is clogged. It is contemplated that the jet pump pressure sensor 238 could be omitted.

In the present implementation, the reverse gate actuator 196 has its own feedback circuit that corrects the position of the motor and thus has an integrated reverse gate position sensor 197 that can send signals to the ECU 228 representative of the position of the reverse gate 110. However, it is contemplated that a separate reverse gate position sensor could be provided. Such a reverse gate position sensor could sense the position of the reverse gate 110 or of the output portion 202 described above.

Figure 22:
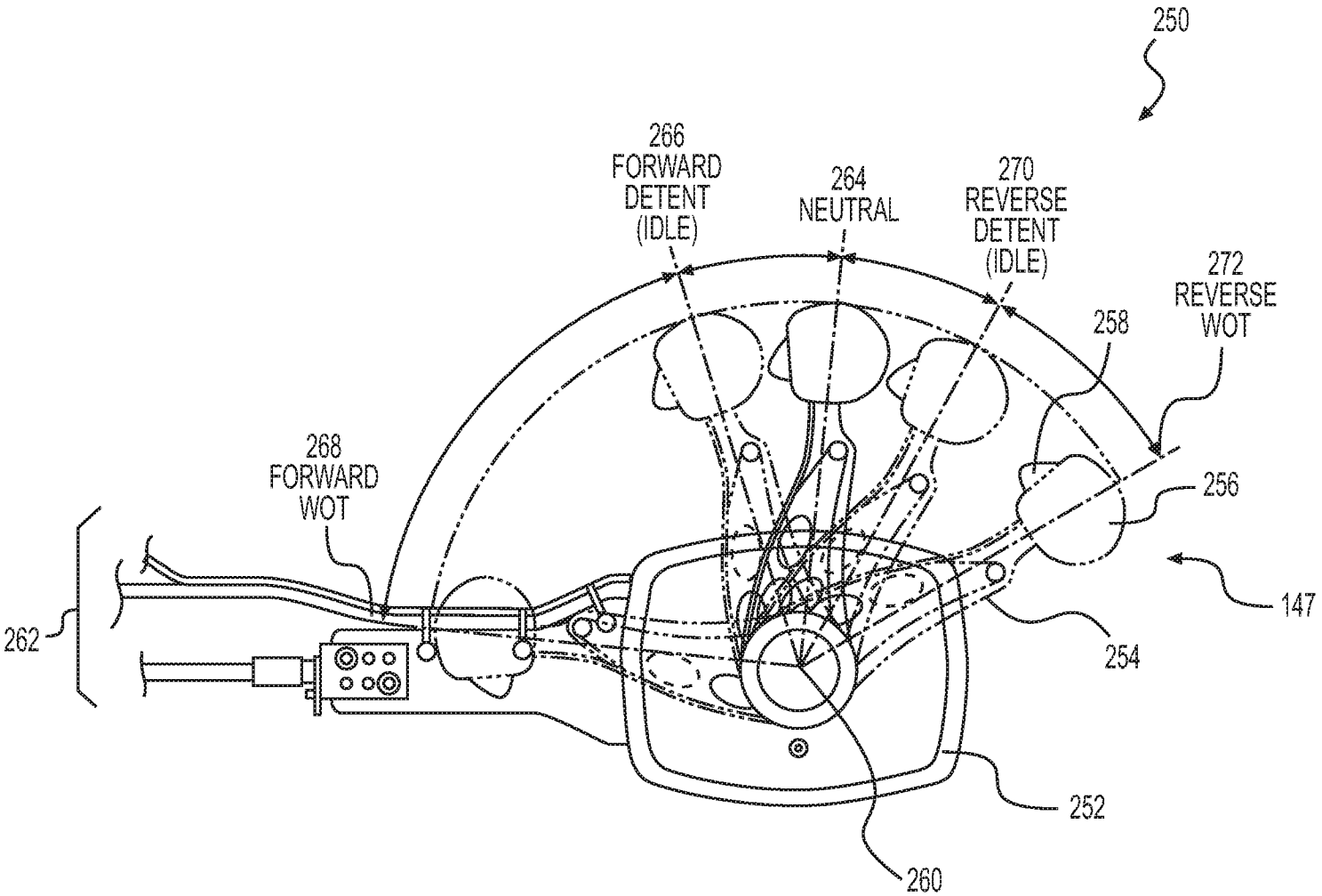
FIG. 22 illustrates various positions of a lever of a combination throttle and reverse operator assembly of the jet propelled boat of FIG. 6.

Turning now to FIG. 22, a combination throttle and reverse operator assembly 250 of the jet propelled boat 120 having the lever 147 will be described. The assembly 250 has a housing 252. The housing 252 houses the throttle operator position sensor 230 and the reverse operator position sensor 236. The lever 147 has a lever arm 254, a knob 256 at an upper end of the lever arm 254 and a button 258 on the knob 256. The lever arm 254 is pivotally connected to the housing 252 about a pivot axis 260 at a lower end thereof. In order to pivot the lever 147, the driver of the jet boat 120 has to first push the button 258 to disengage the lever 147 from its current position. A number of wires 262 extend from the sensors 230, 236 in the housing 252 to the ECU 228 to transfer the signals from the sensors 230, 236 to the ECU 228.

As can be seen in FIG. 22, the lever 147 has a number of positions. The lever 147 has a neutral position 264. From the neutral position 264, the lever 147 can be pivoted forward to a forward detent position 266. In the present implementation, should the lever 147 be released by the driver at a position between the neutral position 264 and the forward detent position 266, the lever 147 is biased back to the neutral position 264. From the forward detent position 266, the lever 147 can be pivoted forward to any position between the forward detent position 266 up to a forward wide open throttle (WOT) position 268. From the neutral position 264, the lever 147 can be pivoted rearward to a reverse detent position 270. In the present implementation, should the lever 147 be released by the driver at a position between the neutral position 264 and the reverse detent position 270, the lever 147 is biased back to the neutral position 264. From the reverse detent position 270, the lever 147 can be pivoted rearward to any position between the reverse detent position 270 up to a reverse wide open throttle (WOT) position 272.

Figure 23:
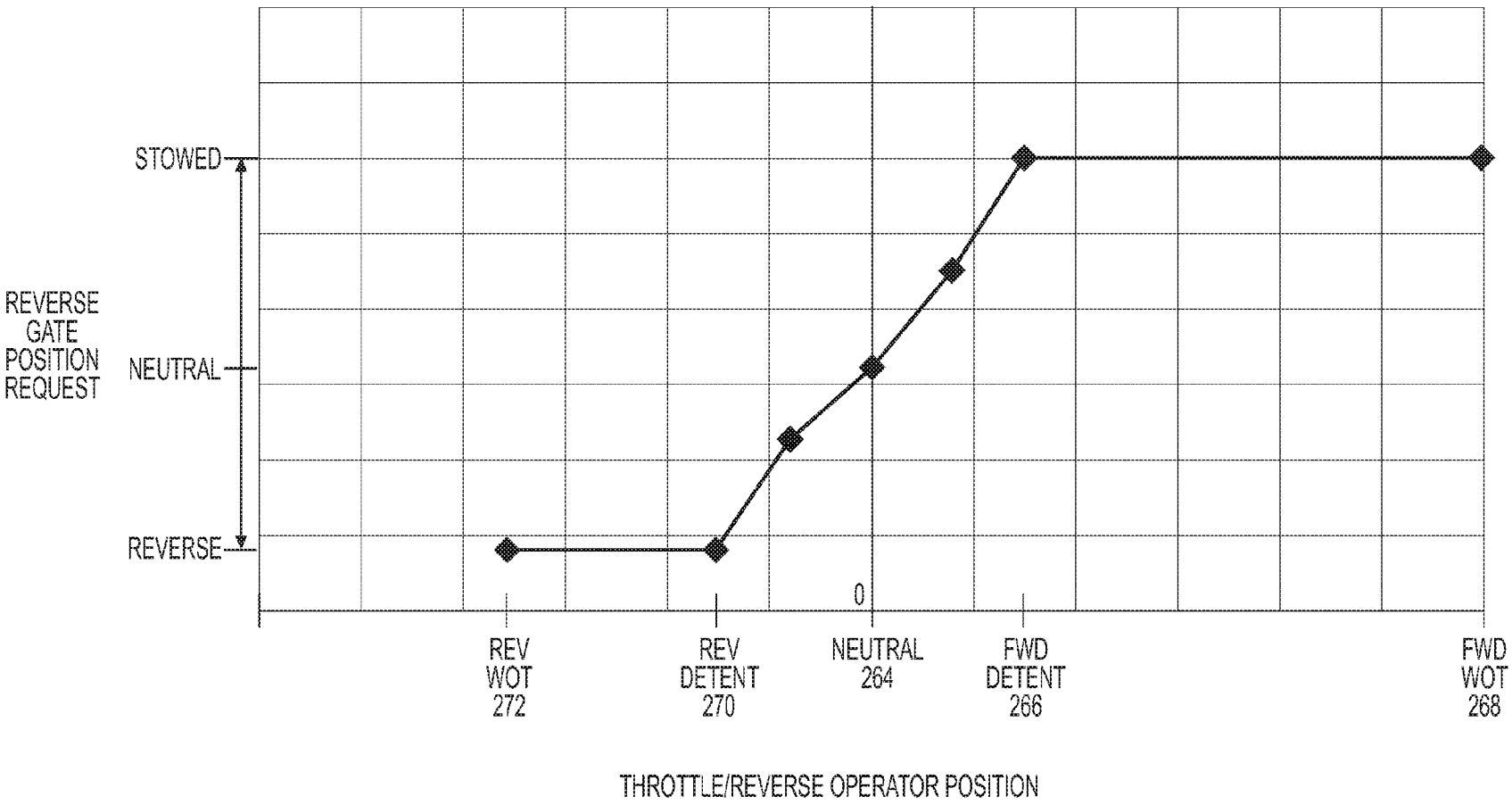
FIG. 23 is an exemplary graph of a reverse gate position request sent to a control unit of the jet propelled boat of FIG. 6 in response to the positions of the operator of FIG. 22.

FIG. 23 illustrates the reverse gate position request signal sent by the reverse operator position sensor 236 to the ECU 228 based on the position of the lever 147 sensed by the sensor 236. As can be seen, at any position of the lever 147 between the forward detent position 266 and the reverse detent position 270, including the neutral position 264, the reverse gate position request signal is a neutral signal. Upon receiving a neutral signal, the ECU 228 controls the reverse gate actuator 196 to move the reverse gate 110 to a neutral position. At any position of the lever 147 between the forward detent position 266 and the forward WOT position 268, the reverse gate position request signal is a forward signal. Upon receiving a forward signal, the ECU 228 controls the reverse gate actuator 196 to move the reverse gate 110 to a stowed position. In the present implementation, upon receiving the forward signal, the ECU 228 controls the reverse gate actuator 196 to move the reverse gate 110 to a fully stowed position. However, it is contemplated that it could be a stowed position that is proportional to a position of the lever 147 between the forward detent position 266 and the forward WOT position 268. At any position of the lever 147 between the reverse detent position 270 and the reverse WOT position 272, the reverse gate position request signal is a reverse signal. Upon receiving a reverse signal, the ECU 228 controls the reverse gate actuator 196 to move the reverse gate 110 to a reverse position. In the present implementation, upon receiving the reverse signal, the ECU 228 controls the reverse gate actuator 196 to move the reverse gate 110 to a fully lowered/reverse position as will be described in more detail below. However, it is contemplated that it could be a reverse position that is proportional to a position of the lever 147 between the reverse detent position 270 and the reverse WOT position 272.

Figure 24:
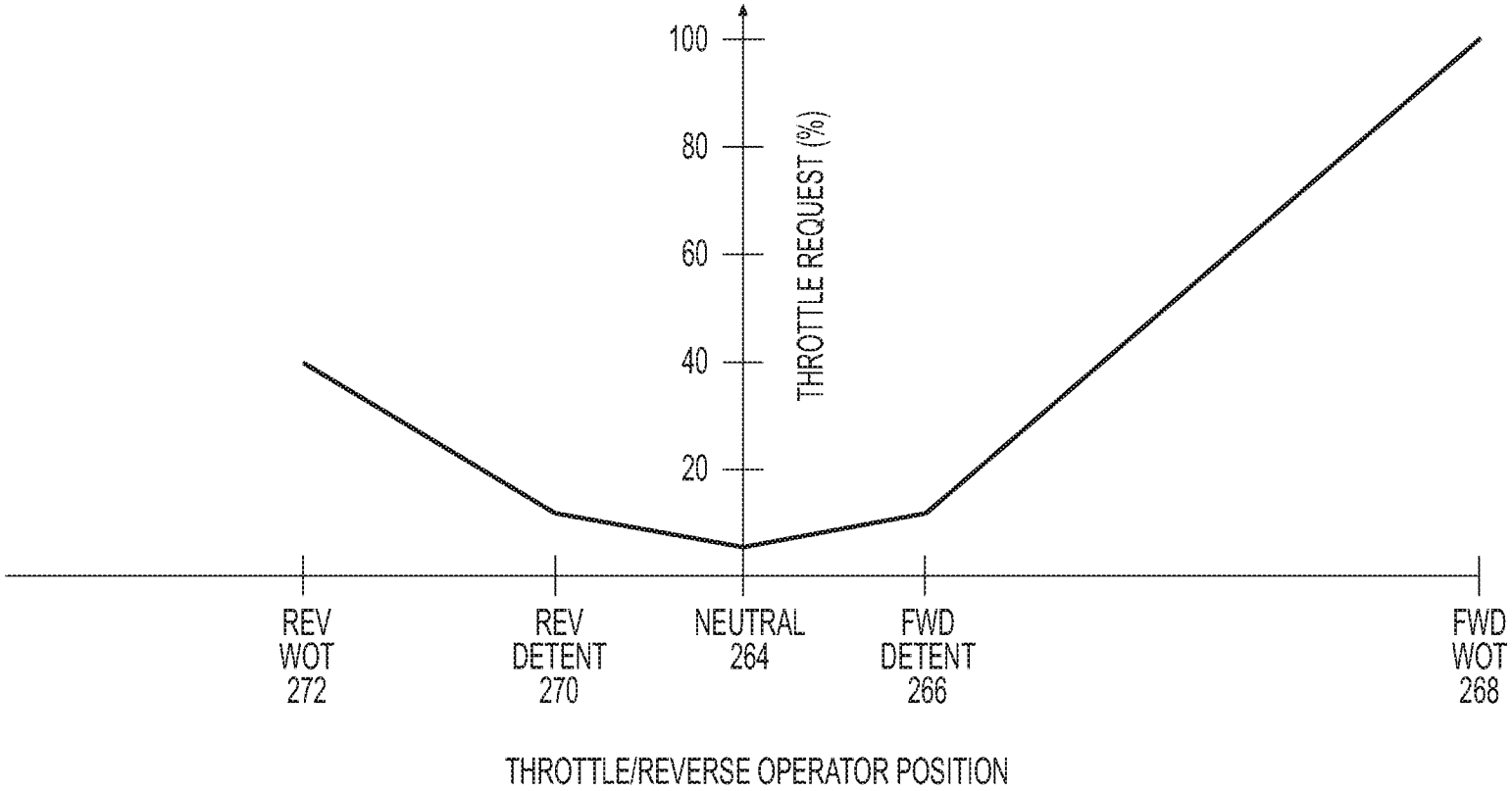
FIG. 24 is an exemplary graph of a reverse gate position request sent to a control unit of the jet propelled boat of FIG. 6 in response to the positions of the operator of FIG. 22.

FIG. 24 illustrates the throttle signal sent by the throttle operator position sensor 230 to the ECU 228 based on the position of the lever 147 sensed by the sensor 230. As would be understood, for a given set of operating conditions, the engine 22 will have a motor speed and an engine torque corresponding to a throttle position. As such, graphs corresponding to the one shown in FIG. 24 could be provided for a motor speed request and a torque request based on a position of the lever 147. As can be seen, at any position of the lever 147 between the forward detent position 266 and the reverse detent position 270, including the neutral position 264, the reverse operator position sensor 236 sends a throttle request signal to the ECU 228 in response to which the ECU 228 controls the throttle valve actuator 226 to move the throttle valve 224 to an idle position to operate the engine 22 at an idle speed. In the present implementation, the idle position corresponds to between 5 and 10 percent of a wide open throttle (WOT) position of the throttle valve 224. At the forward WOT position 268, the throttle operator position sensor 230 sends a throttle signal to the ECU 228 in response to which the ECU 228 controls the throttle valve actuator 226 to move the throttle valve 224 to a WOT position (i.e. a maximum opened position of the throttle valve 224). At the positions intermediate the forward detent position 266 and the forward WOT position 268, the throttle operator position sensor 230 sends a throttle signal to the ECU 228 in response to which the ECU 228 controls the throttle valve actuator 226 to move the throttle valve 224 to a throttle position that corresponds to a position of the lever 147 between the forward detent position 266 and the forward WOT position 268. At the reverse WOT position 272, the throttle operator position sensor 230 sends a throttle signal to the ECU 228 in response to which the ECU 228 controls the throttle valve actuator 226 to move the throttle valve 224 to a maximum reverse throttle position, which is less than the maximum forward throttle position (i.e. the WOT position). In the present implementation, the maximum reverse throttle position is 40 percent of the WOT position. At the positions intermediate the reverse detent position 270 and the reverse WOT position 272, the throttle operator position sensor 230 sends a throttle signal to the ECU 228 in response to which the ECU 228 controls the throttle valve actuator 226 to move the throttle valve 224 to a throttle position that corresponds to a position of the lever 147 between the reverse detent position 270 and the reverse WOT position 272.

Figure 25:
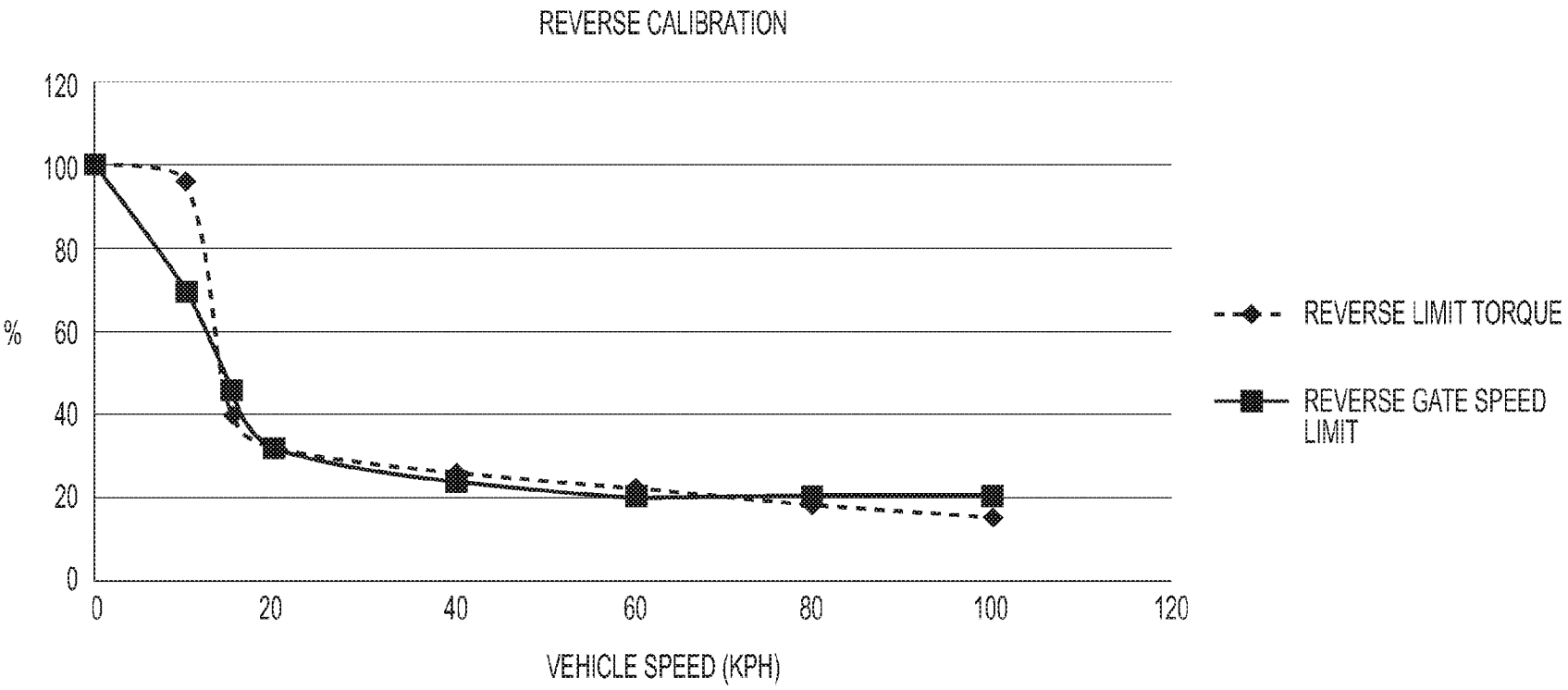
FIG. 25 is an exemplary graph of reverse calibrations of the engine torque and reverse gate speed based on the speed of the jet propelled boat of FIG. 6 used in combination with the method for reversing the watercraft illustrated in FIG. 26.

FIG. 25 is an exemplary reverse calibration graph used in the method described below with respect to FIG. 26. As will be explained in more detail below, when the ECU 228 receives a reverse signal from the reverse operator position sensor 236 in response to the lever 147 being between the reverse detent position 270 and the reverse WOT position 272 or at these positions, the ECU 228, under certain conditions explained below, limits the movement speed of the reverse gate 110 as it moves to the reverse position and limits the engine torque. These limits are based on the forward watercraft speed as sensed by the vehicle speed sensor 106. Although illustrated as a graph, the reverse calibration could also be in the form of one or more lookup tables or one or more mathematical formulae. It is also contemplated that the reverse calibration could be based on motor speed instead of watercraft speed.

As can be seen in FIG. 25, in the present implementation when the jet propelled boat 120 is moving forward up to 17 kph, the reverse gate speed limit drops rapidly. Above 17 kph, the reverse gate speed limit continues to drop, but more gradually. In the present implementation, the ECU 228 controls the movement speed of the reverse gate by controlling the power level applied to the reverse gate actuator 196. The less power is applied, the slower the reverse gate 110 will move. In the present implementation, the percentage of the maximum power level applied to the reverse gate actuator 196 corresponds to the percentage illustrated in the vertical axis of the graph. As such, the faster the boat 120 is travelling forward, the slower the reverse gate will move toward the reverse position. It is contemplated that the power level applied could be reduced in steps as the watercraft speed increases.

As can be seen in FIG. 25, in the present implementation when the jet propelled boat 120 is moving forward at less than 8 kilometers per hour (kph) when the reverse signal is received by the ECU 228, there is no limitation of the reverse limit torque (i.e. the reverse limit torque is at 100%). From 8 kph to 17 kph, the reverse limit torque drops rapidly. Above 17 kph, the reverse limit torque continues to drop, but more gradually. In the present implementation, the percentage illustrated in the vertical axis of the graph corresponds to a percentage of the maximum reverse engine torque stored in the ECU 228. As the name suggests, the reverse limit torque is a limit, not necessarily the engine torque at which the ECU 228 controls the engine. As such, the faster the boat 120 is travelling forward, the lower the maximum engine torque available to the operator is. For example, if the reverse limit torque is 80 percent of the maximum reverse engine torque, but the lever 147 is at a position corresponding to 60 percent of the maximum reverse engine torque, then the ECU 228 controls the engine 22 to operate at 60 percent of the maximum reverse engine torque. However, if the reverse limit torque is 80 percent of the maximum reverse engine torque, but the lever 147 is at a position corresponding to 100 percent of the maximum reverse engine torque, then the ECU 228 controls the engine 22 to operate at 80 percent of the maximum reverse engine torque. It is contemplated that the engine torque could be reduced in steps as the watercraft speed increases. As explained above, there is a relationship between throttle position, motor speed, and motor torque. As such, a graph corresponding to the one of FIG. 25 could be provided for throttle position and motor speed. The limit at which the throttle position, the motor speed or the motor torque is limited is referred to herein as a reverse limit. It is contemplated that the ECU 228 could apply limits to more than one of the throttle position, the motor speed or the motor torque.

When the jet propelled boat 120 reaches 0 kph and then starts moving in reverse, the limits for the reverse gate speed and engine torque are 100% (i.e. the reverse gate speed and the engine torque are not limited).

Figure 26:
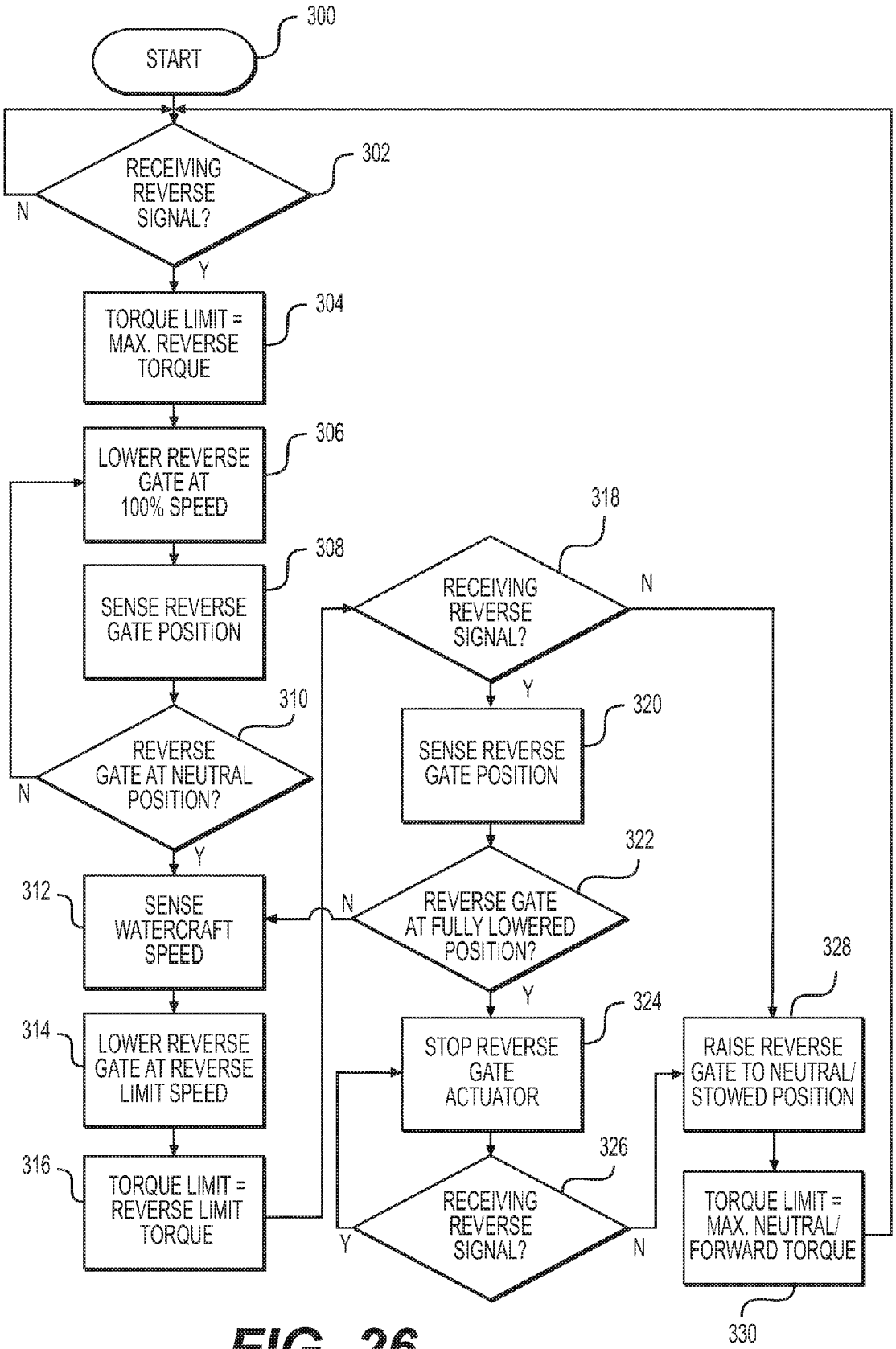
FIG. 26 is a flowchart of a method for reversing a watercraft in accordance with the present technology.
Figure 27:
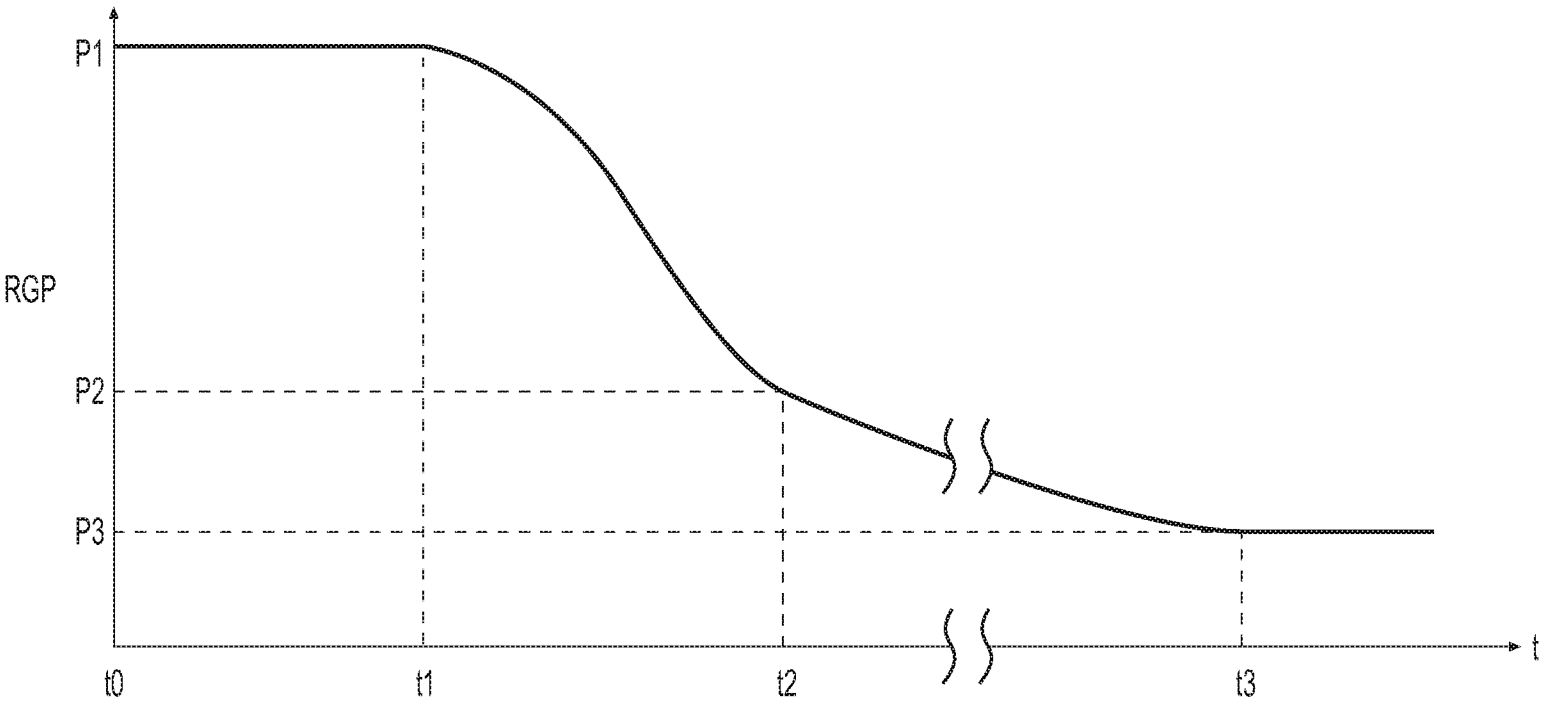
FIG. 27 is an exemplary graph of reverse gate position (RGP) versus time resulting from an implementation of the method of FIG. 26.

Turning now to FIGS. 26 and 27, the method of reversing the jet propelled boat 120 will be described. A method of reversing the personal watercraft 10 is similar to the method described below, except that instead of initiating the method in response to the actuation of the lever 147, the method would be initiated in response to the actuation of the lever 77. In the case of a jet propelled boat 120 having two jet propulsion systems 84 and therefore two reverse gates 110, the method would be simultaneously applied to both jet propulsion systems 84, both reverse gates 110 and, should the jet propelled boat 120 have two engines 22, both engines 22.

FIG. 27 illustrates an example of the reverse gate position (RGP) resulting from the implementation of the method of reversing a jet propelled boat 120 described below. Depending on the particular starting conditions, type of watercraft, motor, jet propulsion system, reverse gate and reverse gate actuator, the curves could look different than illustrated. Also, the position of the times t1, t2 and t3 are intended to indicate the sequence of events in the method of reversing the jet propelled boat 120. It is contemplated that the relative time between events could differ from what is illustrated. Finally, the implementation of the method will be described with respect to an example where the jet propelled boat 120 is initially moving forward at 60 kph or more. The method could be applied to a watercraft moving at any watercraft speed.

As can be seen in FIG. 26, the method for decelerating the watercraft 10 starts at step 300 when the engine 22 of the boat 120 starts. At step 302, the ECU 228 determines if a reverse signal is being received from the reverse operator position sensor 236 which is indicative that the lever 147 has been moved to a position indicative of a desire for the boat 120 to move in reverse. If a reverse signal is not received, then the ECU 228 determines that the lever 147 is not in a position indicative that reversing is desired, and the ECU 228 repeats step 302 (i.e. the position of the lever 147 is continuously monitored). If at step 302 a reverse signal is received, the ECU 228 determines that the lever 147 is in a position indicative that a reverse thrust is desired and the ECU 228 proceeds to step 304.

At step 304, the ECU 304 sets the torque limit of the engine 22 to be the maximum reverse torque, which in the present implementation is about 40 percent of the maximum engine torque. As a result, the ECU 228 controls the engine torque (i.e. the ignition, fuel injection and throttle valve position) based on the throttle signal received from the throttle operator position sensor 230 indicative of the position of the lever 147 in the reverse range of positions. It is contemplated that at any step where the ECU 228 controls the engine torque, that the ECU 228 could take other factors into account such as ambient air temperature and pressure for example. It is also contemplated that at any step where the ECU 228 controls the engine torque, that the ECU 228 could control the throttle position or the motor speed instead. From step 304, the ECU 228 proceeds to step 306.

At step 306, the ECU 228 causes the maximum power (i.e. 100% PWM) to be applied to the reverse gate actuator 196, thereby causing the reverse gate 110 to start moving toward the fully lowered position at its fastest speed. In FIG. 27, the reverse gate 110 is initially (i.e. at time t0) at position P1 corresponding to a fully stowed position of the reverse gate 110. At time t1, the ECU 228 receives the reverse signal (step 302), and as can be seen, the reverse gate 110 start lowering at a rate corresponding to the maximum power being applied to the reverse gate actuator 196. Returning to FIG. 26, it is contemplated that the order of the steps 304 and 306 could be reversed. It is also contemplated that, in some implementation, before the reverse gate 110 starts to be lowered at step 304 the ECU 228 could wait until the engine speed has reduced below a reverse gate actuation speed. The reverse gate actuation speed is a speed of rotation of the engine 22 above which the resulting thrust generated by the jet propulsion system 84 would be too high to lower the reverse gate 110 (i.e. attempting to do so would make the reverse gate 110 either go back to the stowed position due to the thrust, cause damage to the reverse gate 110 and components associated therewith, or the handling of the watercraft could be compromised). Additional details regarding reverse gate actuation speed may be found in U.S. Pat. No. 8,177,594 B2, issued May 15, 2012, the entirety of which is incorporated herein by reference. In the jet boat 120, the reverse gate 110 and the reverse gate actuator 196 are constructed so as to be capable of lowering the reverse gate 110 at any engine speed, therefore there is no need for such a step. From step 306, the ECU 228 proceeds to step 308.

At step 308, the ECU 228 receives a signal from the reverse gate position sensor 197 indicative of the position of the reverse gate 110. At step 310, based on this signal, the ECU 228 determines if the reverse gate 110 has reached the neutral position. In FIG. 27, the neutral position of the reverse gate 110 is position P2. If at step 310 the reverse gate 110 has not yet reached the neutral position (i.e. the reverse gate 110 is between positions P1 and P2), the ECU 228 returns to step 306. If at step 310 the reverse gate 110 has reached the neutral position P2, the ECU 228 proceeds to step 312. This occurs at time t2.

At step 312, the ECU 228 receives a speed signal from the vehicle speed sensor 106 indicative of the forward speed of the watercraft. Then at step 314, based on the speed signal and the reverse calibration (see graph of FIG. 25), the ECU 228 starts supplying power to the reverse gate actuator 110 at a level corresponding to the reverse speed limit of the reverse gate 110.

As such, in the present implementation, should the watercraft be moving forward when the reverse signal is sent, the reverse gate 110 will be moved toward the fully lowered, reverse position slower than it was at step 306. The faster the watercraft is moving, the slower the reverse gate 110 will be moved at step 314. As the watercraft decelerates during the implementation of the method, the speed of the reverse gate 110 will be increased. In FIG. 27, the neutral position P2 is reached at time t2. As can be seen, starting at time t2 the slope of the line is less steep than between times t1 and t2, thereby illustrating the reduced speed of movement of the reverse gate 110.

At step 316, based on the speed of the watercraft and the reverse calibration (see graph of FIG. 25), the ECU 228 limits the torque limit of the engine to the reverse limit torque. Should the lever 147 be at a position corresponding to an engine torque that is less than the reverse limit torque, the ECU 228 will control the engine 22 to supply the engine torque corresponding to the position of the lever 147. Should the lever 147 be at a position corresponding to an engine torque that is greater than or equal to the reverse limit torque, the ECU 228 will control the engine 22 to supply the reverse limit engine torque. As the watercraft decelerates during the implementation of the method, the reverse limit torque will be increased. It is contemplated that the order of steps 314 and 316 could be reversed. It is also contemplated that step 316 could be omitted such that the method does not limit engine torque. From step 316, the ECU 228 proceeds to step 318.

It is contemplated that at step 312 the speed signal could be indicative of a motor speed of the engine 22 obtained from the engine speed sensor 234, in which case the reverse speed limit of the reverse gate 110 at step 314 and the torque limit of the engine 22 at step 326 would be based on a motor speed based reverse calibration.

At step 318, the ECU 228 determines if a reverse signal is still being received from the reverse operator position sensor 236. If not (i.e. the lever 147 has been moved forward of the reverse detent position 270), then the ECU 228 proceeds to step 328 which will be described further below. If at step 318 a reverse signal is still being received, then the ECU 228 proceeds to step 320.

At step 320, the ECU 228 receives a signal from the reverse gate position sensor 197 indicative of the position of the reverse gate 110. At step 322, based on this signal, the ECU 228 determines if the reverse gate 110 has reached the fully lowered, reverse position. In FIG. 27, the fully lowered position of the reverse gate 110 is position P3. If at step 322 the reverse gate 110 has not yet reached the fully lowered position (i.e. the reverse gate 110 is between positions P2 and P3), the ECU 228 returns to step 314. If at step 322 the reverse gate 110 has reached the fully lowered position P3, the ECU 228 proceeds to step 324. At step 324, the ECU 228 stops causing power to be supplied to the reverse gate actuator 196 to stop it and therefore stop the reverse gate 110. This occurs at time t3. The reverse gate 110 will remain in the fully lowered position P3 until step 328 is performed as will be described below.

As would be understood, the time taken for moving the reverse gate 110 from the neutral position P2 to the fully lowered position P3 (i.e. the difference between time t3 and time t2) depends on the speed of the watercraft when step 312 is executed for the first time. Due to the reverse limit speed, the faster the watercraft is going when step 312 is executed for the first time, the longer it will take to move the reverse gate 110 from the neutral position P2 to the fully lowered position P3. Therefore, as the time taken to move the reverse gate 110 from the fully stowed position P1 to the neutral position P2 is essentially constant for all operating condition, the faster the watercraft is going when step 312 is executed for the first time, the longer it will take to move the reverse gate 110 from the fully stowed position P1 to the fully lowered position P3.

From step 324, the ECU 228 proceeds to step 326. At step 326, the ECU 228 determines if a reverse signal is still being received from the reverse operator position sensor 236. If a reverse signal is still being received, then the ECU 228 returns to step 324. If not (i.e. the lever 147 has been moved to the neutral position or a forward position), then the ECU 228 proceeds to step 328.

At step 328, the ECU 228 causes power to be applied to the reverse gate actuator 196 to raise the reverse gate 110. The reverse gate 110 is raised to the one of the neutral position and the fully stowed position that corresponds to the position of the lever 147. Then at step 330, the ECU 228 sets the engine torque limit to be the one of maximum neutral torque and the maximum forward torque corresponding to the position of the lever 147. It should be understood that the new torque limit can be set at step 330 before the reverse gate 110 has reached the neutral or fully stowed position at step 328. From step 330, the ECU 228 returns to step 302.

It is contemplated that steps 304, 306, 308 and 310 could be omitted and that once a reverse signal is received at step 302, the method would proceed to step 312.

Modifications and improvements to the above-described implementations of the present technology may become apparent to those skilled in the art. The foregoing description is intended to be exemplary rather than limiting. The scope of the present technology is therefore intended to be limited solely by the scope of the appended claims.

What is claimed is:

1. A method for reversing a watercraft, the watercraft having a hull, a deck disposed on the hull, a motor connected to at least one of the hull and the deck, a jet propulsion system operatively connected to the motor, a reverse gate connected to at least one of the hull, the deck and the jet propulsion system, the reverse gate being movable between at least a stowed position and a reverse position, and a reverse gate actuator operatively connected to the reverse gate for moving the reverse gate between at least the stowed position and the reverse position, the method comprising:

receiving, in a control unit, a reverse signal from a reverse gate operator position sensor sensing a position of a reverse gate operator;

receiving, in the control unit, a speed signal representative of at least one of a watercraft speed and a motor speed;

controlling, by the control unit, an operation of the reverse gate actuator based at least in part on the speed signal; and moving the reverse gate from the stowed position to the reverse position with the reverse gate actuator in response to receiving the reverse signal, the reverse gate actuator being controlled such that a movement speed of the reverse gate depends on the speed signal.

2. The method of claim 1, wherein the reverse gate actuator is controlled such that the movement speed of the reverse gate at a first of the at least one of the watercraft speed and the motor speed is greater than the movement speed of the reverse gate at a second of the at least one of the watercraft speed and the motor speed, the second of the at least one of the watercraft speed and the motor speed being greater than the first of the at least one of the watercraft speed and the motor speed.

3. The method of claim 2, wherein the reverse gate actuator is controlled such that the movement speed of the reverse gate increases as the at least one of the watercraft speed and the motor speed decreases.

4. The method of claim 2, wherein the at least one of the watercraft speed and the motor speed is the watercraft speed.

5. The method of claim 2, wherein controlling the operation of the reverse gate actuator includes:

applying a first power level to the reverse gate actuator at the first of the at least one of the watercraft speed and the motor speed; and applying a second power level to the reverse gate actuator at the second of the at least one of the watercraft speed and the motor speed, the first power level is greater than the second power level.

6. The method of claim 2, further comprising:

receiving, in the control unit, a throttle signal from a throttle operator position sensor sensing a position of a throttle operator; and in response to receiving the reverse signal, limiting, by the control unit, an operation of the motor based at least in part on the at least one of the watercraft speed and the motor speed.

7. The method of claim 6, wherein limiting the operation of the motor includes limiting at least one of:

a degree of opening of a throttle valve;

the motor speed; and a torque of the motor, to a reverse limit.

8. The method of claim 7, wherein the reverse limit at the first of the at least one of the watercraft speed and the motor speed is greater than the reverse limit at the second of the at least one of the watercraft speed and the motor speed.

9. The method of claim 8, wherein the reverse limit increases as the at least one of the watercraft speed and the motor speed decreases.

10. The method of claim 8, wherein the at least one of the watercraft speed and the motor speed is the watercraft speed.

11. The method of claim 7, wherein the at least one of:

the degree of opening of a throttle valve;

the motor speed; and the torque of the motor, is the torque of the motor.

12. The method of claim 2, wherein, at the second of the at least one of the watercraft speed and the motor speed, the reverse gate actuator is controlled such that the movement speed of the reverse gate from the stowed position to a neutral position is greater than the movement speed of the reverse gate from the neutral position to the reverse position.

13. A method for reversing a watercraft, the watercraft having a hull, a deck disposed on the hull, a motor connected to at least one of the hull and the deck, a jet propulsion system operatively connected to the motor, a reverse gate connected to at least one of the hull, the deck and the jet propulsion system, the reverse gate being movable between at least a stowed position and a reverse position, and a reverse gate actuator operatively connected to the reverse gate for moving the reverse gate between at least the stowed position and the reverse position, the method comprising:

receiving, in a control unit, a reverse signal from a reverse gate operator position sensor sensing a position of a reverse gate operator;

receiving, in the control unit, a speed signal representative of at least one of a watercraft speed and a motor speed;

controlling, by the control unit, an operation of the reverse gate actuator based at least in part on the speed signal; and moving the reverse gate from the stowed position to the reverse position with the reverse gate actuator in response to receiving the reverse signal, the reverse gate actuator being controlled such that a time taken to move the reverse gate from the stowed position to the reverse position depends on the speed signal.

14. The method of claim 13, wherein the reverse gate actuator is controlled such that the time taken at a first of the at least one of the watercraft speed and the motor speed is smaller than the time taken at a second of the at least one of the watercraft speed and the motor speed, the second of the at least one of the watercraft speed and the motor speed being greater than the first of the at least one of the watercraft speed and the motor speed.

15. The method of claim 14, wherein the reverse gate actuator is controlled such that the time taken decreases as a value of the at least one of the watercraft speed and the motor speed when the reverse signal is initially received decreases.

16. The method of claim 14, wherein controlling the operation of the reverse gate actuator includes:

applying a first power level to the reverse gate actuator at the first of the at least one of the watercraft speed and the motor speed; and applying a second power level to the reverse gate actuator at the second of the at least one of the watercraft speed and the motor speed, the first power level is greater than the second power level.

17. The method of claim 14, further comprising:

receiving, in the control unit, a throttle signal from a throttle operator position sensor sensing a position of a throttle operator; and in response to receiving the reverse signal, limiting, by the control unit, an operation of the motor based at least in part on the at least one of the watercraft speed and the motor speed.

18. The method of claim 14, wherein, at the second of the at least one of the watercraft speed and the motor speed, the reverse gate actuator is controlled such that a movement speed of the reverse gate from the stowed position to a neutral position is greater than the movement speed of the reverse gate from the neutral position to the reverse position.

19. A watercraft comprising:

a hull;

a deck disposed on the hull;

a motor connected to one of the hull and the deck;

a jet propulsion system operatively connected to the motor;

a control unit communicating with the motor for controlling an operation of the motor;

a reverse gate operatively connected to at least one of the hull, the deck and the jet propulsion system, the reverse gate being movable between at least a stowed position and a reverse position;

a reverse gate actuator operatively connected to the reverse gate for moving the reverse gate between at least the stowed position and the reverse position, and being in communication with the control unit;

a reverse gate operator position sensor in communication with the control unit; and a reverse gate operator connected to the reverse gate operator position sensor, the reverse gate operator position sensor sensing a position of the reverse gate operator, the control unit including:

a processor; and a tangible computer readable storage medium communicating with the processor and storing instructions that cause the control unit to perform the steps of the method of claim 1.

20. A watercraft comprising:

a hull;

a deck disposed on the hull;

a motor connected to one of the hull and the deck;

a jet propulsion system operatively connected to the motor;

a control unit communicating with the motor for controlling an operation of the motor;

a reverse gate operatively connected to at least one of the hull, the deck and the jet propulsion system, the reverse gate being movable between at least a stowed position and a reverse position;

a reverse gate actuator operatively connected to the reverse gate for moving the reverse gate between at least the stowed position and the reverse position, and being in communication with the control unit;

a reverse gate operator position sensor in communication with the control unit; and a reverse gate operator connected to the reverse gate operator position sensor, the reverse gate operator position sensor sensing a position of the reverse gate operator, the control unit including:

a processor; and a tangible computer readable storage medium communicating with the processor and storing instructions that cause the control unit to perform the steps of the method of claim 13.

* * * * *